US010633070B2

(12) United States Patent
Gai et al.

(10) Patent No.: US 10,633,070 B2
(45) Date of Patent: Apr. 28, 2020

(54) LOCKING DEVICE OF ACTUATION STROKE OF MARINE VESSEL CONTROL SYSTEM

(71) Applicant: Ultraflex S.p.A., Casella (IT)

(72) Inventors: Pietro Gai, Casella (IT); Marcella Gai, Busalla (IT); William P. Michel, Sarasota, FL (US)

( * ) Notice: Subject to any disclaimer, the term of this patent is extended or adjusted under 35 U.S.C. 154(b) by 0 days.

(21) Appl. No.: 16/372,916

(22) Filed: Apr. 2, 2019

(65) Prior Publication Data

US 2019/0308710 A1 Oct. 10, 2019

(30) Foreign Application Priority Data

Apr. 5, 2018 (IT) ..... 102018000004237

(51) Int. Cl.

| | |
|---|---|
| ***B63H 20/12*** | (2006.01) |
| ***B63H 20/16*** | (2006.01) |
| ***B63H 20/00*** | (2006.01) |
| *F15B 15/14* | (2006.01) |

(52) U.S. Cl.

CPC ..... *B63H 20/12* (2013.01); *B63H 20/001* (2013.01); *B63H 20/16* (2013.01); *F15B 15/14* (2013.01)

(58) Field of Classification Search

CPC ..... B63H 20/12; B63H 20/001; B63H 20/16
See application file for complete search history.

(56) References Cited

U.S. PATENT DOCUMENTS

| | | | | |
|---|---|---|---|---|
| 5,549,837 | A * | 8/1996 | Ginder | H01F 1/447 252/62.52 |
| 7,267,588 | B1 * | 9/2007 | Griffiths | B63H 21/265 114/172 |
| 2013/0046417 | A1 * | 2/2013 | Schroter | E21B 47/024 700/302 |
| 2014/0186200 | A1 * | 7/2014 | Petersen | F01D 7/00 417/393 |

FOREIGN PATENT DOCUMENTS

| | | |
|---|---|---|
| CN | 202251219 | 5/2012 |
| DE | 102012001271 | 7/2013 |
| EP | 2848822 | 3/2015 |
| EP | 3156320 | 4/2017 |
| JP | 2006117117 | 5/2006 |

* cited by examiner

*Primary Examiner* — Stephen P Avila
(74) *Attorney, Agent, or Firm* — Themis Law

(57) ABSTRACT

A directional control system of a marine vessel includes a steering control member manually operated by a user and operationally connected to a direction-variation member acting on or in the water, such as at least one rudder blade or at least one outboard engine, the direction-variation member having an angular position that is controlled by the steering control member; and a locking system locking the free variation of the angular position of the direction-variation member, which can be activated and deactivated to allow the variation of angular position and carry out a directional change, the locking system including a hydraulic cylinder having a piston dividing the cylinder into two chambers, which are connected by a bypass circuit that can be opened and closed by a switching member.

19 Claims, 13 Drawing Sheets

LOCKING DEVICE OF ACTUATION STROKE OF MARINE VESSEL CONTROL SYSTEM

FIELD OF THE INVENTION

The present invention concerns a device for locking the actuation stroke of control kinematic chains in boats, which device comprises:

a closed hydraulic circuit in which a fluid circulates, said circuit comprising at least one locking actuator with a locking member movable along a predetermined stroke and operationally connected to the control kinematic chain and which locking actuator can be alternatively switched into a braked or locked condition of said locking member and into a condition of free movement of said locking member in relation to the predetermined stroke thereof;

said closed hydraulic circuit further comprising a switching control unit to switch from the active and inactive conditions of the locking actuator, the control unit consisting of a preventing member to prevent the fluid flow in said closed circuit and which switching unit can be alternatively controlled between a condition of free flow of fluid corresponding to the condition in which the locking member is free in relation to its stroke and a condition of at least limited flow rate of fluid or increased resistance to circulation in which the movement of the locking member along the stroke is braked or in a condition of completely preventing the fluid flow in which the locking member cannot move along its predetermined stroke.

BACKGROUND OF THE INVENTION

Devices of this type are known in the state of the art and are used in different applications, such as for example the steering assistance of high-power engines or in making variable distance adjustments of parts relatively moving between each other.

Currently, this type of devices comprises a locking actuator consisting of a hydraulic cylinder with a chamber in which a piston is slidingly connected on a side or on two sides to at least one piston rod which can be translated axially together with the movement of the piston along the cylinder, the cylinder being provided with two inlet ports which respectively communicate with one of the two chambers of the cylinder separated from each other by the piston and the two ports being connected to a bypass duct in which a preventing unit to prevent the fluid flow, which can be controlled in the active or inactive preventive condition, typically a valve, preferably a servo-controlled valve, is provided.

Thanks to a partially closed condition of the valve, the preventing of the fluid flow or the reduction of the flow port allows to completely close the fluid flow from a cylinder chamber to the other and to increase the flow resistance and therefore to stop the displacement of the piston in the cylinder or to brake such displacement.

By acting on a switching unit, the user can therefore control the switching condition of the preventing unit between the active and inactive conditions and therefore lock, brake or free the actuation of a kinematic control chain of a control system.

The locking member can be operationally coupled to any element of a kinematic control chain and is therefore extremely versatile. The use of preventing units that can be activated and deactivated by electric or electromechanical or electronic control makes it extremely easy to achieve and implement the switching unit of the locking actuator.

Despite the locking devices of this type have optimal functionalities, they have the drawback of requiring preventing units, such as valves of relatively complex construction, providing movable mechanical parts and being subject to wear as far as the sealing in a closed condition is concerned. Moreover, there also being a need for braking the kinematic chain, the control of the valves must operate progressively, requiring for example the need of actuations with electric motors rather than with electromagnets.

This involves integration issues for the locking devices both in newly constructed systems and when modifying existing systems.

SUMMARY OF THE INVENTION

Object of the invention is to achieve a device of the type described in the beginning, which is as reliable from a functional point of view as the known devices but has a simpler and less bulky construction and which can be activated and deactivated by using electric controls that require an easy implementation.

The invention solves the problem in question with a device having the characteristics described hereinafter, In particular, the invention achieves the preset purposes with a device for locking the actuation stroke of control kinematic chains in boats, which device comprises:

a closed hydraulic circuit in which a fluid circulates, said circuit comprising at least one locking actuator with a locking member movable along a predetermined stroke and operationally connected to the control kinematic chain and which locking actuator can be alternatively switched into a braked or locked condition of said locking member and into a condition of free movement of said locking member in relation to the predetermined stroke thereof;

said closed hydraulic circuit further comprising a switching unit to switch from the active and inactive conditions of the locking actuator, the control unit consisting of a preventing member to prevent the fluid flow in said closed circuit and which switching unit can be alternatively controlled between a condition of free flow of fluid corresponding to the condition in which the locking member is free in relation to its stroke and a condition of at least limited flow rate of fluid or increased resistance to circulation in which the movement of the locking member along the stroke is braked or in a condition of completely preventing the fluid flow in which the locking member cannot move along its predetermined stroke and wherein the fluid consists of a magnetorheological liquid or a ferrofluid, whereas the switching unit to switch the locking actuator between active and inactive conditions consists of both a magnetic field generator coupled to at least one section of the circuit and an element for varying the intensity of the magnetic or the flux of the magnetic field that permeates said magnetorheological liquid or said ferrofluid.

As far as the modes for varying the intensity of the magnetic field or magnetic flux that permeate the magnetorheological liquid is concerned, it is possible to provide different embodiment variants.

According to a first embodiment, the magnetic field generator is of the electromagnetic type and a switch/regulator of the power supply of the magnetic field generator is provided and opens and closes the connection of the power source to said magnetic field generator and/or regulates the intensity of the power supply signal to said generator.

An embodiment variant provides that the magnetic field generator consists of one or more permanent magnets, and a magnetic field generator for partial and progressive or complete compensation of the magnetic field generated by the permanent magnet, a shielding element to partially and progressively shield or completely shield the magnetic field generated by the permanent magnet, a varying element to vary either the magnetic flux or the intensity of the magnetic field generated by the permanent magnet which permeates said fluid by relatively moving the permanent magnet relative to the fluid, are provided in combination with said permanent magnets, alternatively to or in combination with each other.

As far as the aforesaid embodiment variants are concerned, an implementation embodiment provides that the shielding element and/or the permanent magnet can be moved by means of motorized actuators along predetermined paths and between two end positions in which the intensity of the magnetic field permeating said fluid or the magnetic flux through said fluid is such that said fluid assumes a predetermined condition of maximum viscosity and a predetermined condition of minimum viscosity, respectively, elastic elements being provided in combination and permanently biasing the permanent magnet and/or the shielding element in the position in which the fluid assumes the condition of maximum viscosity and an automatic unit for decoupling the permanent magnet and/or shielding element from the motorized actuator in case of absence of electric power supply to said motorized actuator.

According to a preferred embodiment, the circuit provides for a partial narrowing or reduced-diameter section in the bypass duct, said magnetic field generator being provided at said narrowing or said section whose diameter is reduced with respect to that of the bypass duct.

Therefore, in the device according to the invention, the free flow of fluid which circulates in the closed circuit is determined by the change from the fluid to quasi-solid state, i.e. by the change of state between a condition of lesser viscosity and a condition of greater viscosity of the magnetorheological fluid or the ferrofluid.

It is possible to use different types of control members of the switching unit, depending on the applications. In particular, such control members of the switching units consist of manual switches having at least two stable positions, one corresponding to the condition of generating a magnetic field and the other to the condition of absence of magnetic field. In turn, the switches or electric switches can be of the button, lever type or controlled by other mechanical means for interfacing with the hand of the user.

In the presence of a power source of the magnetic field generator which provides a power supply signal of the generator of variable intensity, the intensity of the magnetic field can also be regulated to different values thus generating not only the conditions of free movement or complete locking, but also the conditions of greater or lesser braking of the movement.

In this case, it is possible to provide regulators of the intensity of the power supply signal such as sliders or selectors controlling the power source of the power supply signal of the magnetic field generator, so as to supply the latter with a signal power corresponding to a predetermined magnetic field intensity and therefore to a preset fluid viscosity condition between two extreme conditions of maximum and minimum possible viscosities.

Even in this case, different solutions are possible and available for the technician of the field as far as the magnetic field generator, the power source thereof and the regulating and actuating means of the magnetic field generator are concerned.

As far as the magnetic field generator is concerned, it can be any type of electromagnet adapted to generate a magnetic field intensity, i.e. magnetic flux, variable depending on the power of the power supply signal.

A further specific application of the device according to the invention concerns the directional control systems of boats comprising two or more outboard marine engines connected together by tie bars to control the steering in a synchronized manner and in which, both during the setting-up step and in use step, the relative steering angles (rudder angles) between the individual engines with respect to each other have to be changed to compensate for the systematic directional defects or to allow to position the engines relatively to one another so that to carry out particular movements of the boat.

In this application, it is possible to provide one or more of the previously described embodiments, in particular in relation to the activation/deactivation of the locking actuators and of the switching unit.

In addition to the free movement and locking conditions, it is also possible to provide regulating members top regulate the power of the power supply signal of the magnetic field generator in this application and therefore of the fluid viscosity condition to set a resistance to the free movement and therefore a braking condition.

Instead, a further specific application concerns devices auxiliary to the manual steering control of high-power marine engines and in which a directional control system of a boat comprises:

a steering control member manually operated by a user and operationally connected to a direction-variation member acting on or in the water, such as at least one rudder blade or at least one outboard engine, and whose angular position with respect to the longitudinal axis of the boat is controlled by said control member, locking means to lock the free variation of the angular position of said at least one rudder blade and/or said at least one engine, these means being able to be activated and deactivated in order to allow said variation of angular position, to carry out a directional change, and in which said means consist of a hydraulic actuator comprising a sealed cylinder and a piston dividing the cylinder into two chambers and which chambers are connected by a bypass circuit which can be opened and closed by means of a switching member, the piston rod or cylinder being articulated to the kinematic chain for the angular movement of the blade or engine and/or to the steering control member.

Systems of this type are known for example by the U.S. Pat. No. 7,325,507. This document provides that the steering action, i.e. the force exerted on the steering bar or on the steering arm of the engine through said bar, is manually generated by the helmsman. The system only exerts a locking action of the engine or rudder and therefore of the steering bar when needing not to make a directional variation, i.e. a change of route. This is advantageous since in the presence of very powerful engines or important rudder surfaces, the force that must be exerted on the steering bar is considerable and must be maintained for the entire time, so that to avoid a spontaneous change in the orientation of the rudder blade or of the engine which tends to reach the maximum angle possible of swinging of the bar, i.e. of the rudder or engine, in combination with the hydrodynamic behavior of the boat and engine also with reference to the shape of the propeller. A situation of this kind is very dangerous, especially when the cruising speed is high.

However, in the aforesaid document, the switching member of the valve which opens and closes the bypass circuit of the locking cylinder consists of an end part of the handle of the steering bar, which part is mounted swinging along an axis substantially parallel to the rotation axis of the engine or rudder blade and which part actuates a valve which opens and closes a connection circuit of the two chambers of a double-acting cylinder. The opening of the valve mechanically controlled by the swinging of the end part of the steering bar with respect to the part combined with the engine, allows the fluid to flow from one cylinder chamber to the other and therefore frees the swinging of the bar.

By bringing back the handle to the resting position, the valve closes the passage and the movement remains locked until the end part of the steering bar makes a new actuation.

According to the present invention, in these directional control systems of a boat, the fluid circulating between a cylinder chamber and the other consists in a magnetorheological fluid or a ferrofluid, whereas the switching member to switch the locking actuator between the active and inactive conditions consists of both a magnetic field generator coupled to at least one section of the bypass circuit, i.e. whose magnetic field permeates at least said section of the bypass circuit, and a varying element to vary the magnetic intensity or the flux of the magnetic field permeating said magnetorheological liquid or said ferrofluid.

In a preferred embodiment, the magnetic field generator is of the electromagnetic type and a switch/regulator of the power supply of the magnetic field generator is provided and opens and closes the connection of the power source to said magnetic field generator and/or regulates the intensity of the power supply signal to said generator, said switch regulator consisting of an electric switch that opens and closes the power/regulating circuit of the power supply signal to said magnetic field generator.

Said electric switch is in turn controlled by buttons, levers, sliders or other mechanical members.

An embodiment provides that the electric switch is controlled by a button with two stable positions corresponding to an open position and to a closing position of the circuit.

Instead, an embodiment variant provides that the electric switch is controlled by the engine's steering arm, which is articulated to the engine itself to be able to swing along a given switching-control stroke limited with respect to the steering stroke around an axis parallel to the steering axis, and which stroke in both directions with respect to a central position controls the electric switch in the direction of closing the power circuit of the magnetic field generator, whereas in the intermediate position of the stroke of the steering arm, between the two swing positions with respect to the engine, the switch is controlled in the direction of opening the power circuit of the magnetic field generator.

In this embodiment, the steering arm is swingingly articulated to the engine in the area of its fastening base, i.e. the end where it is fastened to the engine itself.

Still according to a further alternative embodiment, the steering arm consists of two parts articulated to each other so as to swing in the two steering directions with respect to an intermediate position of substantial alignment of the two parts of the arm, one part being stationarily fastened to the engine and the other part forming the arm end opposite to the engine and swinging around an axis parallel to the steering axis, in the two steering directions with respect to an intermediate position of alignment with the part fastened to the engine and along a limited switching stroke to switch the power circuit of the magnetic field generator into the closed condition, whereas in said intermediate position of alignment of the two segments of the steering arm, the electric switch is controlled in the open condition of the power circuit of the magnetic field generator.

According to a further characteristic, it is possible to provide a control for regulating the magnetic field intensity, the control allowing the viscosity of the magnetorheological fluid or the ferrofluid to be varied between a minimum value and a maximum value thereby the steering movement is either completely free or locked respectively in the absence of magnetic field or in the condition of maximum intensity of the magnetic field, whereas for values of the magnetic field intensity intermediate between the minimum value and the maximum value, a corresponding viscosity intermediate between the maximum value and the minimum value is set, causing the steering movement to be correspondingly braked.

The regulating means comprise a slider or a selector which can be actuated by the user and which controls a power circuit of the magnetic field generator, in the sense of supplying the generator with a variable electric signal adapted to determine a magnetic field of corresponding intensity depending on the settings of the selector.

The selector can be a slider or a stepped selector or an electronic circuit with a touch interface or the like.

Advantageously, according to an embodiment, the bypass circuit has a narrowing or diameter reduction in an intermediate section between the two inlets to the cylinder chambers, the narrowing or narrowed section being combined with the magnetic field generator in the space volume permeated by the field of said generator.

According to a further embodiment variant to be applied to all embodiments described above, the switching member, i.e. the control means of the electric switch, can also be connected by wireless connections and therefore also allow to control the locking means remotely.

With reference to the application related to the steering systems, two switches, which feel the different displacement directions for example of the end part of the bar combined with the gripping handle with respect to the part of the bar fixed to the engine or directly or indirectly to the rudder blade or of a different control member, must therefore simply be housed in the steering bar.

The actuation of one or the other switch closes the power circuit of the locking means, causing its temporary disabling and therefore the freeing of the rotation movement of the bar and therefore of the engine and the rudder blade.

At least two switches or a three-way switch must therefore be housed in the bar and not at the same time structures such as complex valves and hydraulic means opening and closing them. In addition to the advantage in terms of the simplicity and space, there is also the advantage of reducing malfunction risks since the system is simpler and especially the valves and hydraulic control means do not require excessive miniaturization.

An advantageous embodiment provides to achieve the locking device of the actuation stroke of controls so that to ensure the locking and/or braking condition also in the absence of an electric power supply source, i.e. in the absence of power supply signals of the magnetic field generator.

In this embodiment variant, instead of a magnetic field generator consisting of an electromagnet, the use of permanent magnet which generates a stable magnetic field intensity so that to involve such a variation of the viscosity of the magnetorheological fluid or ferrofluid to determine the locking condition already described above, whereas varying means of the magnetic field permeating the magnetorheological fluid or ferrofluid are provided in combination with said permanent magnet for varying the its viscosity.

Similarly to that which has been described above, it is possible to provide, in combination with a permanent magnet, a magnetic field generator, for example an electromagnet which can be controlled to generate a magnetic field of complete compensation or reduction of the magnetic field generated by the permanent magnet.

For the control of the generator of the magnetic compensation field, it is possible to use the control and command systems described in the previous applications and examples with reference to the magnetic field generator whose field has the functions of the permanent magnet, the way to change the control steps depending on the present further embodiment being clear for the technician of the field.

Further embodiment variants of the embodiment which provide a permanent magnet for influencing and setting a condition of viscosity of the magnetorheological fluid or ferrofluid and which are alternatives, but which can also possibly be combined between them with the previous embodiment variant providing for the generator of the magnetic compensation field, can respectively consist of displacing means to displace the permanent magnet relatively to the magnetorheological fluid or ferrofluid so that to vary the magnetic flux through said fluids, by changing the viscosity, i.e. making the fluids less viscous and therefore eliminating the locking condition, and/or of shielding means of the magnetic field of the permanent magnet with respect to the magnetorheological fluid or ferrofluid.

In the embodiment variant which provides for the displacement of the permanent magnet with respect to the magnetorheological fluid or ferrofluid, motorized displacing means for displacing the magnet which are controlled directly or indirectly by the user thanks to control members are provided, whereas the permanent magnet is firmly biased in the position of maximum interference of the magnetic field with the magnetorheological fluid thanks to elastic means and to a removable mechanical connection between said permanent magnet and the motorized displacement means thereof, which, in the absence of a power supply, release the permanent magnet from the motorized displacement actuator and therefore allow the elastic means to bring the permanent magnet to the stable position of maximum interference with the magnetorheological fluid or ferrofluid.

Similarly, when the permanent magnet is provided fixed, i.e. has a stable position with respect to the magnetorheological fluid or ferrofluid, actuators for displacing the shielding means between two positions of complete shielding of the magnetic field with respect to the magnetorheological fluid or ferrofluid and of non-shielding of the magnetic field are provided, said shielding means being also biased firmly in direction of the non-shielding position of the permanent magnet and said shielding means being mechanically connected in a releasable way to the displacement actuators thereof.

Similarly to the embodiment in which the permanent magnet is displaced, the displacement actuators allow to control the locking and/or breaking condition by controlling the viscosity thanks to the displacement of the shielding means with respect to the magnet so that to generate shielding conditions varying between a complete shielding condition and a complete absence of shielding with an active control action of the user, whereas in the absence of power supply to the actuators, the shielding means are released from the displacement actuators and automatically brought to the non-shielding condition of the magnetic field and therefore of maximum viscosity of the magnetorheological fluid or ferrofluid.

Additional characteristics are described hereinafter.

BRIEF DESCRIPTION OF THE DRAWINGS

These and other characteristics and advantages deriving therefrom will become clearer in the following description of some exemplary embodiments shown in the accompanying drawings, in which.

DETAILED DESCRIPTION OF EMBODIMENTS OF THE INVENTION

With reference to the embodiments shown in the following figures and described below, these are two application examples which must not be considered as limiting the present invention, but which demonstrate its general nature and the vast possibility of use.

With reference to the first application example, the device according to the present invention is used to make a tie bar of two marine engines relatively to their steering, which bar can be regulated in length, allowing to change the relative angular steering positions of the two engines at will, for example to correct directional defects or to combine the propulsive thrusts so that to displace the boat according to predetermined trajectories.

Figure 2:
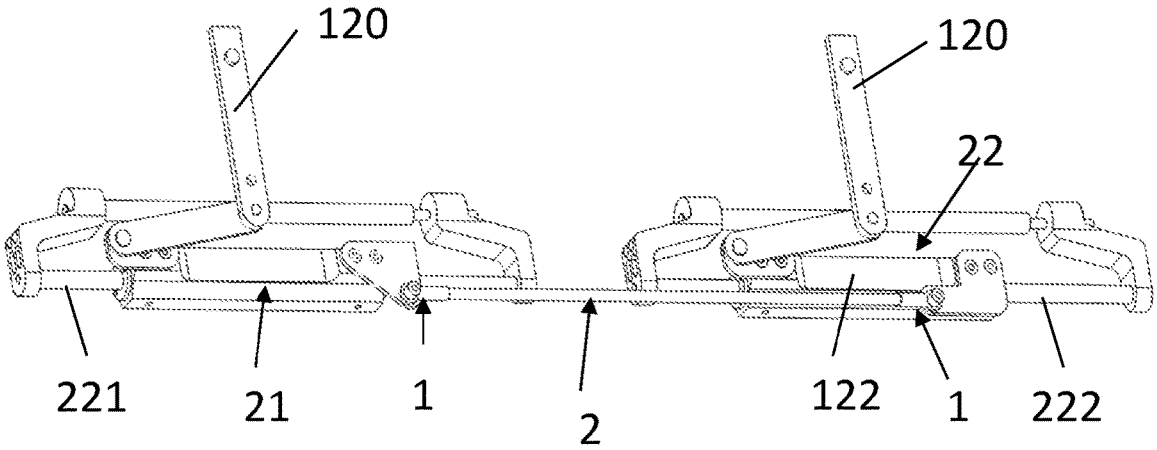
Fig. 2 (Prior Art)
FIG. 2 shows a view of a steering control device of a couple of marine engines and in which the two engines are connected to each other by a tie bar according to the state of the art.

FIG. 2 shows a solution according to the state of the art in which a steering bar, which can be regulated in length thanks to a manual intervention, and in particular according to the Italian patent 0001359224, is provided.

A tie bar of this type is shown in FIG. 2, numeral 1 denotes the coupling joints while 2 denotes the threaded bar. The covering tube is not shown but extends from one of the two opposite coupling joints 1 to the other. In the example shown, the tie bar is not directly connected to the steering arms 120 of the two engines, but connects two sliders 21 and 22 to each other of which at least one consists of the cylindrical body 122 of an actuating cylinder that is displaced on its piston rod 222 thanks to the supply of the pressurizing liquid alternatively in one of the two opposed chambers of the actuating cylinder, the chamber being controlled by a steering wheel 23 with which a hydraulic pump connecting to the hydraulic actuating cylinder 22 by means of two ducts 24 forming a closed circuit with the pump is actuated. The tie bars according to the known art are also used in combination with different types of engine steering control devices such as, for example, mechanical or electromagnetic devices, or even when the control is directly performed manually on an engine.

In the known art, there are systems which provide two or more engines whose steering is controlled by a dedicated actuator for each engine, the bar replaced being by electronic systems which regulate the relative angular position of each engine with respect to the other or to the other engines.

While in case of tie bars according to FIG. 2, the drawbacks are clear since the setting of the relative angular positions of the engines can be set once only and cannot be varied during navigation, in the system which uses an electronic tie bar there is the drawback that a mechanical constraint ensuring the constraint of the engines in case of failure of the electronic controls is missing between the engines.

Figure 3:
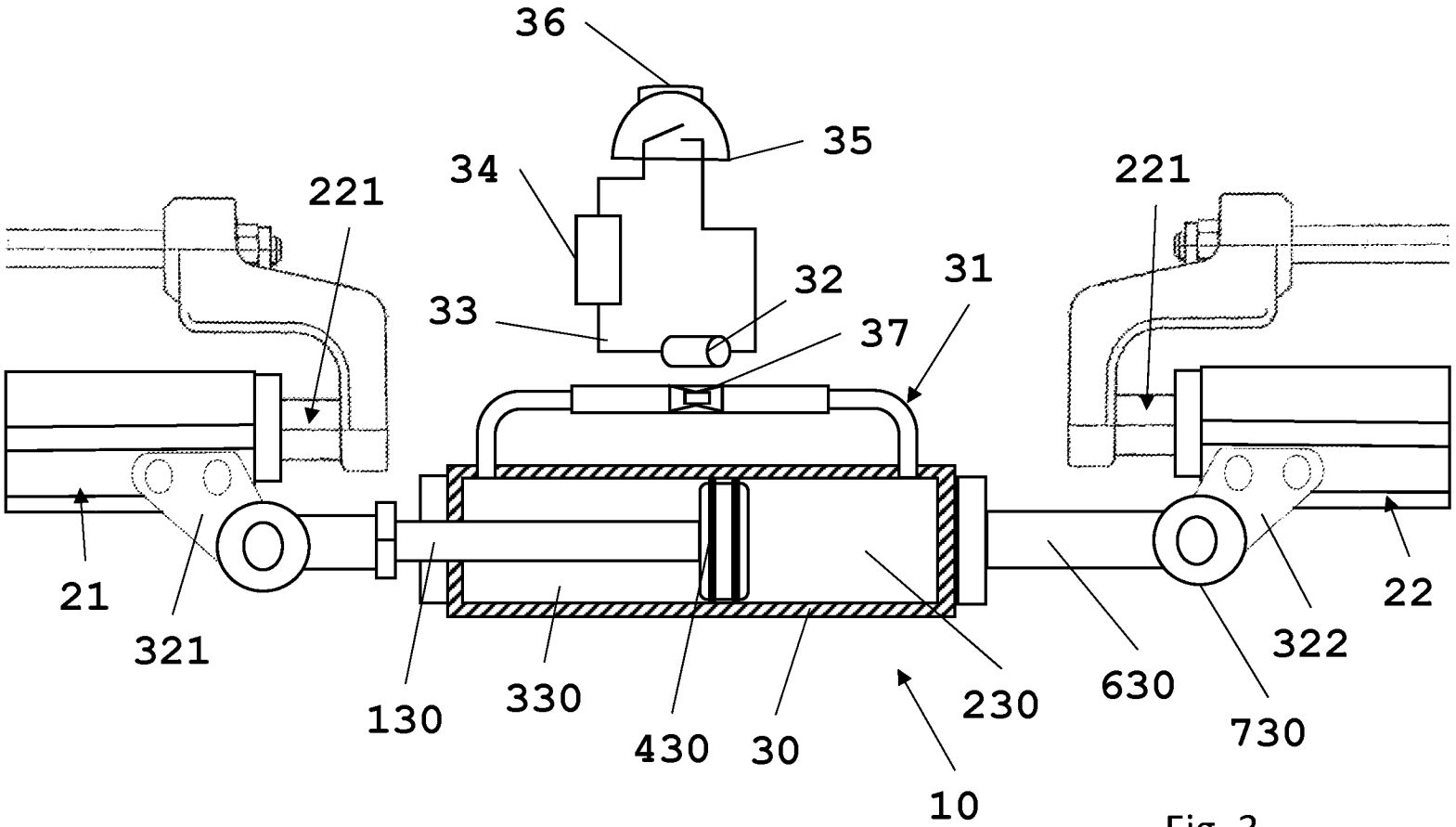
FIG. 3 schematically shows a scheme of a steering system of two marine engines connected to each other by a tie bar according to the present invention.

FIG. 3 shows the application of a device according to the invention to achieve a tie bar of the type that can be varied at will, in an immediate way, also during navigation, the length of the bar and therefore the angular position of the engines, maintaining a direct mechanical coupling between the engines.

In this exemplary embodiment, only two engines are shown, but the solution can obviously be extended to three or more engines constrained to each other by a tie bar of a length that can be regulated.

The steering of each of the two engines 20 is controlled by a dedicated actuating cylinder which can be hydraulic, pneumatic, oleodynamic, electromechanical or of any other type and which is an oleodynamic actuator denoted by 21, 22 in the embodiment shown. Therefore, a steering control member actuates the two actuators 21, 22, which act on the steering arm 120 of the engines 20.

In the exemplary embodiment, the piston rods 221, 222 of the actuators 21, 22 are stationary as occurs in oleodynamic steering devices of the state of the art, for example as described in EP2848822, whereas the cylinders 121, 122 are displaced in two directions along them correspondingly for example to the displacement direction of the steering control member such as a wheel 23, a rudder bar or a rudder wheel, or the like.

The two cylinders 121, 122 are connected to each other by a tie bar 10 which consists of a hydraulic cylinder 30 of the "unbalanced" type. The piston rod 130 goes back in the cylinder and the fluid flows from the right chamber 230 to the left chamber 330 through a bypass circuit 31 connecting the openings of said two chambers 230, 330 to each other. A piston 430 is displaced inside the cylinder 30 and sealingly separates the two chambers 230, 330. The piston rod 130 is integral with the piston 430 and comes out from the cylinder.

The fluid flows from the left chamber to the right one and vice-versa through the bypass 31. The circuit composed of the cylinder 30 and the bypass 31 is a passive circuit. On one side, the piston rod 130 is mechanically articulated to the cylinder 121 of the steering actuator 21 of the left engine thanks to an articulation plate 321 which is fixed to the cylinder 121 of the steering actuator 21 and which brings a coupling end 530 to the end of the piston rod 130.

Instead, on the opposite side, the cylindrical body delimiting the chambers 230, 330 towards the outside is connected thanks to an extension shaft 630 which is articulated with an end 730 to a plate 322 fixed to the cylinder 122 of the steering actuator 22 which controls the steering of the right engine.

The bypass circuit 31 is filled with a magnetorheological fluid or ferrofluid, i.e. a fluid which changes the characteristics of viscosity under the effect of a magnetic flux permeating it.

At least one magnetic field generator, for example an electromagnet 32, is combined with at least one section of the bypass circuit 31 and the generator is activated and deactivated thanks to a power circuit 33 comprising a power source 34 and a switching member 35 which closes and opens the power circuit by acting on an electric switch such as an electric switch or the like 36.

Therefore, by acting on the switching control member, the magnetic field generator is activated/deactivated and causes a fluid viscosity variation in the bypass circuit.

The viscosity variation can occur between two predetermined values of minimum and maximum viscosity. When the minimum viscosity value is set, the fluid substantially flows without any resistance from one chamber to the other of the cylinder 30, releasing the two engines and allowing, thanks to a separate control of the steering actuators of the engines, to change their relative angular position with reference to their steering rotation axis.

The maximum viscosity value is selected so that the fluid no longer substantially flows and cannot therefore flow from one chamber to the other of the cylinder 30, constraining in a stable way the two engines to each other in the relative angular position set.

In order to ensure a better locking condition of the sliding of the piston 430 and therefore locking the sliding of the piston rod in the two directions, it is advantageous to provide a section with a section constriction in the bypass circuit, such as a narrowing or the like which is denoted by 37 in FIG. 3. The constriction or the narrowing 37 are positioned relatively to the magnetic field generator 32 so that the field generated permeates said bypass section comprising said narrowing or said constriction. This way, whenever the maximum viscosity condition obtainable should not be sufficient to reach a stationary locking condition of the sliding of the piston, but only a greater resistance to the fluid flow from one chamber to the other, the combination of these high viscosity values with the resistance generated by the narrowing or constriction allow to reach the desired locking condition.

Since there are different types of magnetorheological fluids or ferrofluids, also the dimensions of the narrowing or reduction of the flow port of the bypass depend on the type of fluid used and can be preventively set in the production site.

In the exemplary embodiment shown, the closing and opening of the bypass circuit occurs thanks to an electric switch whose switching from the closing position to the opening position occurs manually thanks to a switching control member 35 which is shown not limitedly as a button, however it is possible to provide, in combination or alternatively to the electric switch 36, a progressive or step regulator of the intensity of the power supply signal of the magnetic field generator. Thanks to this, in combination with the closing or opening of the power circuit, it is possible to vary the power of the power supply signal between a minimum value and a maximum value and therefore the intensity of the magnetic field. The regulation occurs in steps or in a continuous way by correspondingly controlling the power source at the delivery of a power supply signal of a predetermined power between the two minimum and maximum values. The minimum value can correspond to the power value 0 and the maximum value to the magnetic flow necessary to maximize the viscosity or to make the fluid solid.

Still according to a further characteristic, the aforesaid tie bar of two or more engines can be provided in combination with the steering control system of the engines which can be switched from an steering control condition independent of the steering of each engine independently of the other(s) in a condition in which the steering control controls the contemporaneous steering of all engines present. In this case, the invention can provide that the tie bar be locked or unlocked in an automatic way or by manual command relatively to the occurrence of said two conditions.

In particular, according to an exemplary embodiment, when the steering of the engines occurs separately for each engine, each steering actuator of each engine is actuated separately by a dedicated control unit and the tie bar is automatically locked.

However, when the steering of the engines occurs contemporaneously such as occurs for example while "cruising" or "at speed," the tie bar is made "rigid," i.e. is locked relatively to its length for example in an automatic way.

In the oleodynamic version of the actuators, the actuating cylinders are each supplied by a separate supply unit of the fluid in the steering condition, independently of the engines, whereas the actuating cylinders are supplied in parallel by the same power unit when the engines are steered together.

An embodiment of this variant provides the use of an electrovalve and a compensation channel between the tanks of the power units.

Moreover, for completeness of information, the two power units must be arranged at the same height and possibly near each other. This to prevent the oil from flowing from one to the other, coming out by simple principle of the communicating vessels or by (if arranged away from one another) the swinging of the boat and consequent height variation between them.

An embodiment variant provides that, in order to prevent the oil flow from one of the two units to the other, it is possible to arrange one of the two control units higher than the other with a vent cap and the second lower with a sealed cap.

Obviously, the solution described herein with reference to the use of a hydraulic steering system can be modified mutatis mutandis in a mechanically, electromechanically or electronically controlled system in which the actuators are of mechanical, electromechanical or magnetic type.

The switching controls between the two engine steering modes can be generated by any control member. The automatic switching of the locking or unlocking condition of the coupling shaft, i.e. of the closing and opening of the power circuit of the magnetic field generator, can occur thanks to a coupling of the switching control member between the two steering modes with the opening/closing switches of the regulation circuit and/or with the regulating members of the power of the power supply signal of the magnetic field generator, or thanks to an electronic control unit configured to receive the signals for switching the steering mode of the engines and which automatically generates a servocontrol signal of the opening and closing of the power circuit.

Still according to a further embodiment, the activation or deactivation of the locking or unlocking condition of the length variation of the tie bar and/or the regulation of the mechanical resistance to said length variation can also occur depending on the further parameter in relation to the navigation mode of the boat, such as for example: Maneuver, low cruising speed, normal speed, high speed, etc.

In this case, the measurement of the navigation condition can occur thanks to the measurement of the speed of the boat and/or thanks to the measurement of the number of revolutions of the engines and/or also on the basis of the position of the control levers of the setting of the number of revolutions of the engine, as well as thanks to the rotation direction of the propellers or propulsive jet.

Advantageously, this embodiment allows to prevent or to apply a high resistance to the length variation of the tie bar when the navigation conditions are so that the operation may be dangerous, on the basis of the results of the aforesaid parameters or one or more of these.

Still according to a further embodiment variant, as a parameter for activating or deactivating the locking condition of the tie bar, it is also possible to use, alternatively or in combination with the parameters already described, the wave condition, i.e. to measure the pitch and/or rolling of the boat and to evaluate if the unlocking or locking of the tie bar can be dangerous or not and therefore to allow the switching of the steering mode depending on the variants described above with the engines that can be steered independently of each other or together and therefore the locking or unlocking condition of the length variation of the tie bar.

Even in this case, this functionality is managed by an electronic control unit which is configured to perform the aforesaid functionalities.

An embodiment provides that the control unit is of the type comprising at least one processor which executes a control program that configures the processor and the peripheral devices associated thereto in order to perform the functionalities described above.

Figure 4:
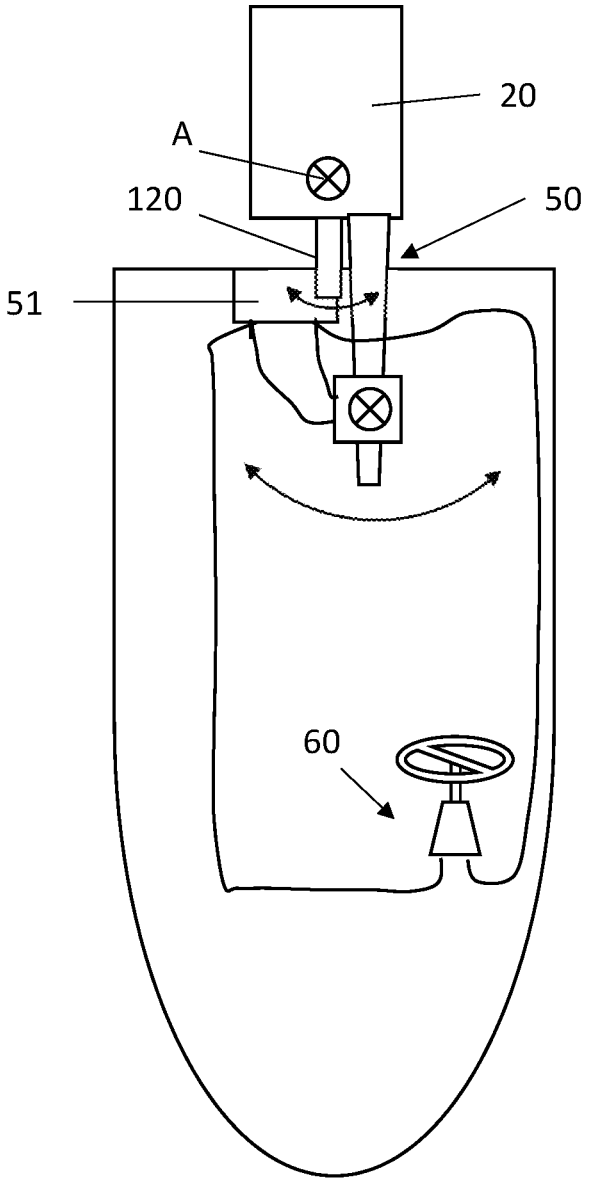
FIG. 4 shows a schematic plan view from above of a further application of the device according to the present invention, in which the device is used to lock/unlock the steering rotation of an outboard marine engine by means of the manual steering rod.
Figure 5:
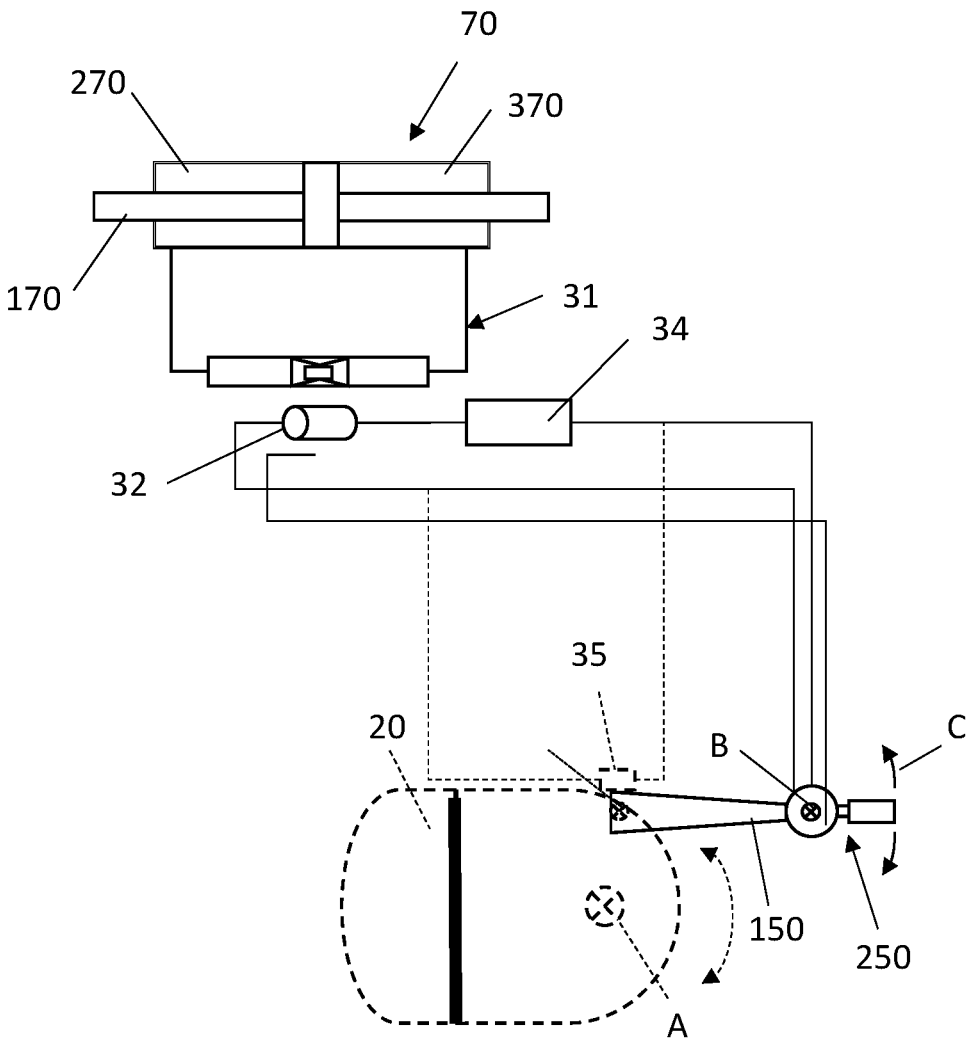
FIG. 5 shows a system scheme of the device in the application according to FIG. 4.

FIGS. 4 and 5 show a further application embodiment of the device according to the present invention.

In case of this application example, it is a directional control system of a boat, which system comprises a swinging steering bar 50 actuated manually and operatively connected to a direction-variation member which acts on or in the water, such as a rudder blade (not shown) or an outboard engine. Locking means 51 of the steering bar are combined with the steering bar 51 in the steering position and which means can be activated to maintain said bar in a predetermined swinging position and deactivated to allow the displacement of said bar to a swinging position to perform a direction change. Said locking means can be switched into locking or unlocking condition of the swinging of the tie bar by switching actuators which are controlled by a control member provided on the arm.

FIG. 4 shows a schematic example of a system according to the present invention, in which in addition to the directional control, by using the steering bar 50, the directional control can also be carried out by a remote control unit generically denoted by 60.

In FIG. 4, a boat with an outboard engine 20 fixed to the transom is shown. A steering bar 50, which can be provided with different control members for controlling different functionalities of the engine, such as for example the number of revolutions of the engine, the forward direction or the neutral condition, the position of the engine with respect to the transom, is fixed to the outboard engine 20. The steering bar 50 is integral with the engine which is rotatably mounted together with the bar itself around a steering axis denoted by A.

The invention provides locking means to lock the rotation of the engine which are denoted by 52 and which are controlled by a control member.

The locking actuator can consist of a set of unbalanced cylinder, bypass and magnetic field generator for the status variation of a magnetorheological fluid or ferrofluid which fills the circuit formed by the bypass and by the chambers of the unbalanced cylinder, as in the example of the previous figures.

An alternative embodiment provides the use of a double-acting cylinder, such as the one traditionally used as steering actuator of the engine, for example such as the one shown in FIG. 5. In this case, the two chambers of the cylinder are connected to each other by a bypass circuit similarly to that described in the previous example.

Similarly to the embodiment in the previous example, even in this case the bypass circuit can comprise a narrowing or a reduction of flow port provided coincident with the space permeated by the magnetic field generated by a magnetic field generator.

Figure 1:
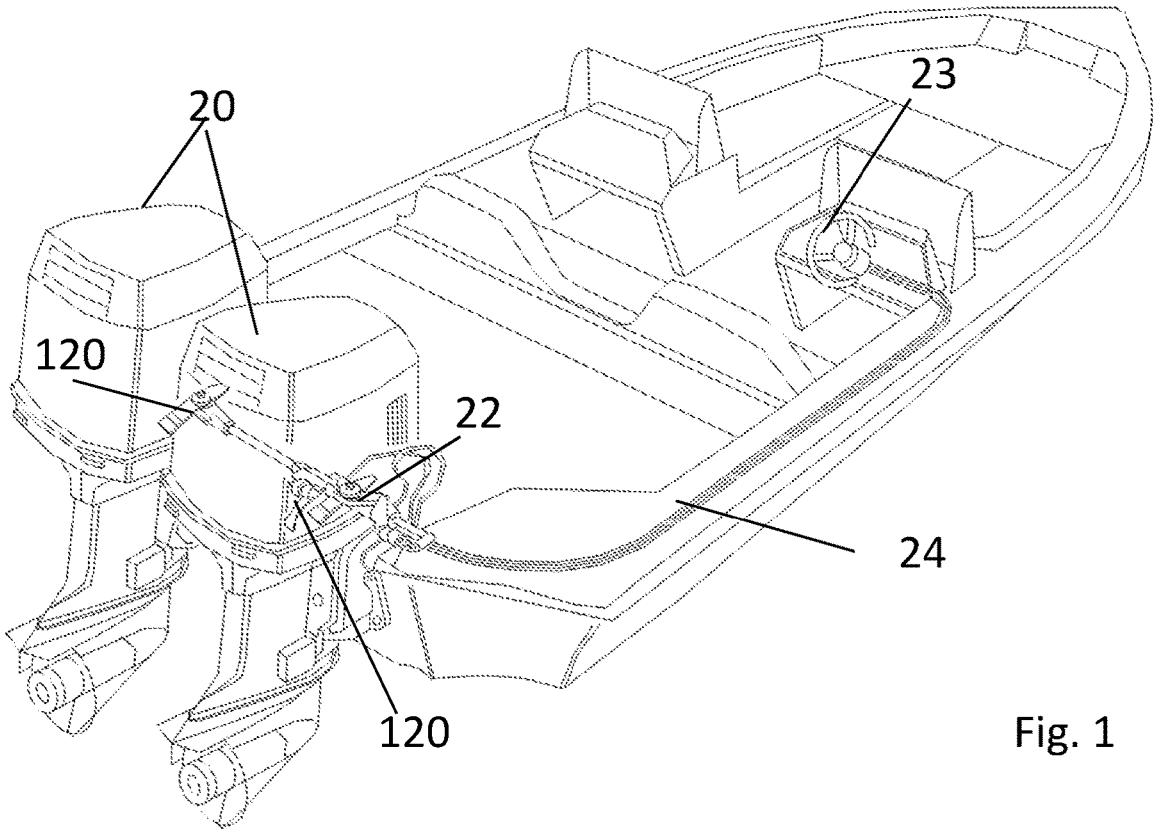
FIG. 1 shows a perspective view of a boat comprising two engines which are controlled by a steering member.

In case of a cylinder, such as the one in the example of FIGS. 1 and 2, the steering arm of the engine 120 is fixed to the body of the cylinder or to the piston rod, whereas respectively the piston rod or cylinder body are fixed to a stationary corresponding part on the boat.

When the power circuit of the magnetic field generator 32 is opened or closed, the magnetorheological fluid switches to the most viscous or solid state and the fluid can no longer flow from one-cylinder chamber to the other, preventing the sliding of the piston and therefore of the piston rod. Therefore, the engine can no longer rotate around the steering axis.

When the magnetic field is absent or the intensity is low, so the fluid has a low viscosity, the sliding of the piston and piston rod are free and the engine can rotate around the steering axis.

In the embodiment which provides for a double-acting cylinder similar to the one for the actuation of the steering, the piston rod is stationary and is fixed to the boat, while the cylinder moves along it. In this case, the steering arm 120 of the engine is connected to the body of the cylinder.

This variant operates in a completely similar way as the previous one.

Also in relation to this application, it is possible to provide, alternatively or in combination, regulating means of the resistance to the rotation which consist in providing a variable regulation between discrete levels of signal power or a continuous variation of the power of the power supply signal of the magnetic field generator, thanks to which it is possible to regulate the intensity of the magnetic field generated and therefore the viscosity of the fluid between a condition of maximum and minimum viscosity, thus obtaining a braking effect of the rotation of the engine that can be regulated. This allows to regulate the mechanical resistance of the engine with respect to its rotation and therefore to generate assistance to the maintenance of the steering position set manually by the operator through the bar.

The switching member of the activate/deactivate condition of the locking or unlocking of the rotation of the engine or of the condition of greater or lesser resistance to the steering rotation of the engine can be of any type and, mutatis mutandis, said member can be made in a similar way as one of the embodiment variants described with reference to the example in FIGS. 1 to 3.

A possible embodiment can provide that the switching member, thanks to which the opening and closing of the power circuit of the magnetic field generator is controlled, consists of a button combined with for example the handle for controlling the number of revolutions of the engine.

A further embodiment provides for an electric switch or a combination of two electric switches which are actuated, in the sense of opening the power circuit of the magnetic field generator, when the steering bar 50 has performed a first angular displacement of predetermined extent and limited with respect to the arc necessary for causing a steering of the engine.

In relation to this example, the bar 50 is swingingly articulated to the engine around an axis parallel to the steering axis A of the engine and, during this swinging in one or the other direction, when the bar has performed the angular displacement of limited extent relatively to the engine, reaching a stroke limit position, the bar 50 itself cooperates with a switch such as for example a limit switch or the like which closes and opens the power circuit of the magnetic field generator, allowing to continue the swinging stroke of the bar 50, this time together with the arm 120 of the engine and therefore allowing to set a steering angle.

Moreover, the displacement in the opposite direction involves an angular stroke of the bar with respect to the engine which is of limited angular extent. Even in this case, in the stroke limit condition of relative angular displacement of the bar 50 with respect to the engine 20, the bar actuates an electric switch, for example a limit switch which opens the power circuit of the magnetic field generator and allows the setting of a bar angle of the engine.

In the resting condition of the bar, preferably in the central condition between the two stroke limit positions relatively to the engine 20, the power circuit of the magnetic field generator is normally closed and the engine 20 is locked with reference to a swing around the steering axis A.

A third embodiment variant is shown in detail in FIG. 5. In this case, the steering bar 50 is rotationally integral with the engine 20, i.e. it cannot rotate with respect to it. The bar 50 is formed by two segments of which one root segment 150 fixed to the engine and the other end segment 250 which is swingingly articulated to the root one 150 for a predetermined angle in the two directions around an axis B parallel to the steering axis A of the engine. The end segment 250 can swing relatively to the root segment 150 of the bar 50 between two positions defined respectively by a stroke limit and similarly to that which was previous described, a switch such as a limit switch or the like which open the power circuit of the magnetic field generator, unlocking the cylinder 70, are respectively combined to the stroke limit positions.

The example of FIG. 5 shows a cylinder 70 slidingly mounted on a shaft 170 which is stationary. The chambers 270, 370 of the cylinder 70 are connected by a bypass, thus forming a closed circuit. A magnetic field generator 32, which field permeates at least one section of the bypass circuit 31, is combined to the bypass. Even in this example, the section permeated by the magnetic field can advantageously have a narrowing or a reduction of the flow port in order to improve the locking effect when the magnetic field determines an increase in the viscosity of the fluid provided in the circuit consisting of the bypass and the cylinder chambers.

In FIG. 5, with continuous lines, the variant which provides that the switching control of the activation of the locking or unlocking condition of the steering of the engine is only composed of the end segment 250 of the bar 50 with respect to the root segment 150, whereas the dashed lines show the variant in which the whole bar is swinging.

Also in case of this application example, it is possible to provide a viscosity regulation varying from a minimum value corresponding to the unlocking condition of the steering rotation of the engine, to a maximum value of viscosity corresponding to a locking condition of the steering rotation of the engine, by changing the power of the power supply signal of the magnetic field generator similarly to what previously described.

In this case, in addition to the limit switches or other similar members, it is possible to provide a control member of the power source which sets a predetermined power of the power supply signal and therefore a predetermined viscosity which causes a predetermined resistance to the rotation of the engine itself.

The regulation which can occur at discrete steps or with a continuous progression as described previously, can also be carried out or set during navigation to adjust the rotation resistance to the navigation conditions. In this case, it is possible to provide a selector which for example has different positions corresponding to different braking conditions of the steering rotation of the engine, which are each preset for a navigation condition, the positions being marked with symbols representing the navigation condition.

The control member of the power of the power supply signal of the magnetic field generator can be provided in combination with the switching control of the activation/deactivation of the locking condition according to one of the variants described with reference to FIG. 5.

Even in this case, it is possible to provide an electronic control unit which comprises a processor which executes a control program configured to receive the signals of the switches and/or the regulating members and to generate the control signals of the power source.

Similarly to the first application example, the electronic control unit can provide inputs for signals detecting the navigation condition which can be generated by one or more detecting devices, such as for example by a navigation speed meter and/or an indicator of the number of revolutions of the engine. A control software executed by the electronic control unit can configure the latter so that it automatically generates control signals of the power source for a setting of the power of the power supply signal of the magnetic field generator depending on the navigation condition and therefore regulates the resistance of the engine to the steering correspondingly, without the manual intervention of the user, alternatively or in parallel to this.

In the embodiments of the locking device according to the present invention according to FIGS. 1 to 5 and respectively in combination with an application related to a tie bar of two marine engines relatively to the mutual angular steering position and in combination with locking or braking means of the steering rotation condition of a marine engine by means of the manual steering arm thereof, a magnetic field generator which produces the magnetic field necessary for increasing the viscosity of the fluid to an extent such as to generate the locking condition, is provided.

This solution operates according to intrinsic safety conditions, especially in relation to an absence of electric power and therefore in the absence of the generation of a magnetic field, especially as far as the embodiment related to the application of the manual steering of the engine according to FIGS. 4 and 5 and the relative description parts are concerned. In fact, in the absence of a magnetic field, the magnetorheological fluid or ferrofluid assume a condition of maximum fluidity or minimum viscosity and therefore the steering rotation of the engine is free, thus allowing to drive the boat in a condition of emergency.

In relation to the application of the locking device of the length variation of the tie bar of two engines, although the solution of FIG. 3 is functional, it does not ensure an intrinsic level of safety of the tie bar, since in the absence of the power supply of the magnetic field generator, the magnetorheological fluid assumes the maximum fluidity condition, i.e. the minimum viscosity and allows the tie bar to vary its length, therefore the stable mechanical constraint between the two engines connected thereto is lost.

In the following FIGS. 6 to 12, three alternative embodiments which modify the embodiment according to FIG. 3 are shown, in order to confer an intrinsic safety functionality to the locking device in case the power used for the magnetic field generator is lost.

The three variants have the shared characteristic of providing as a magnetic field generator, whose magnetic flux permeates the magnetorheological or ferrofluid so that to increase the viscosity to an extent such as to prevent the flow of the fluid between the two chambers of the actuating cylinder, a permanent magnet denoted by 32' in said figures. The permanent magnet is sized so that to provide a magnetic field useful to bring the magnetorheological fluid to the maximum viscosity condition, whereas in combination with said permanent magnet, all three embodiment variants are provided with means of total or progressive compensation which reduce the intensity of the magnetic field generated by the permanent magnet on the fluid, thus causing the reduction of the viscosity of this fluid to the minimum value possible or to intermediate values between the maximum and minimum possible viscosity. Still shared by the three embodiment variants is the fact that the compensating means are made so that in the absence of power, the compensating means assume the condition in which the fluid is exposed to the magnetic field of the permanent magnet in a stable and automatic way and assumes the maximum viscosity condition. Therefore, in this condition, the locking device assumes in a stable and automatic way the operative safety condition in which the tie bar is locked in relation to one of its length variations.

Figure 6:
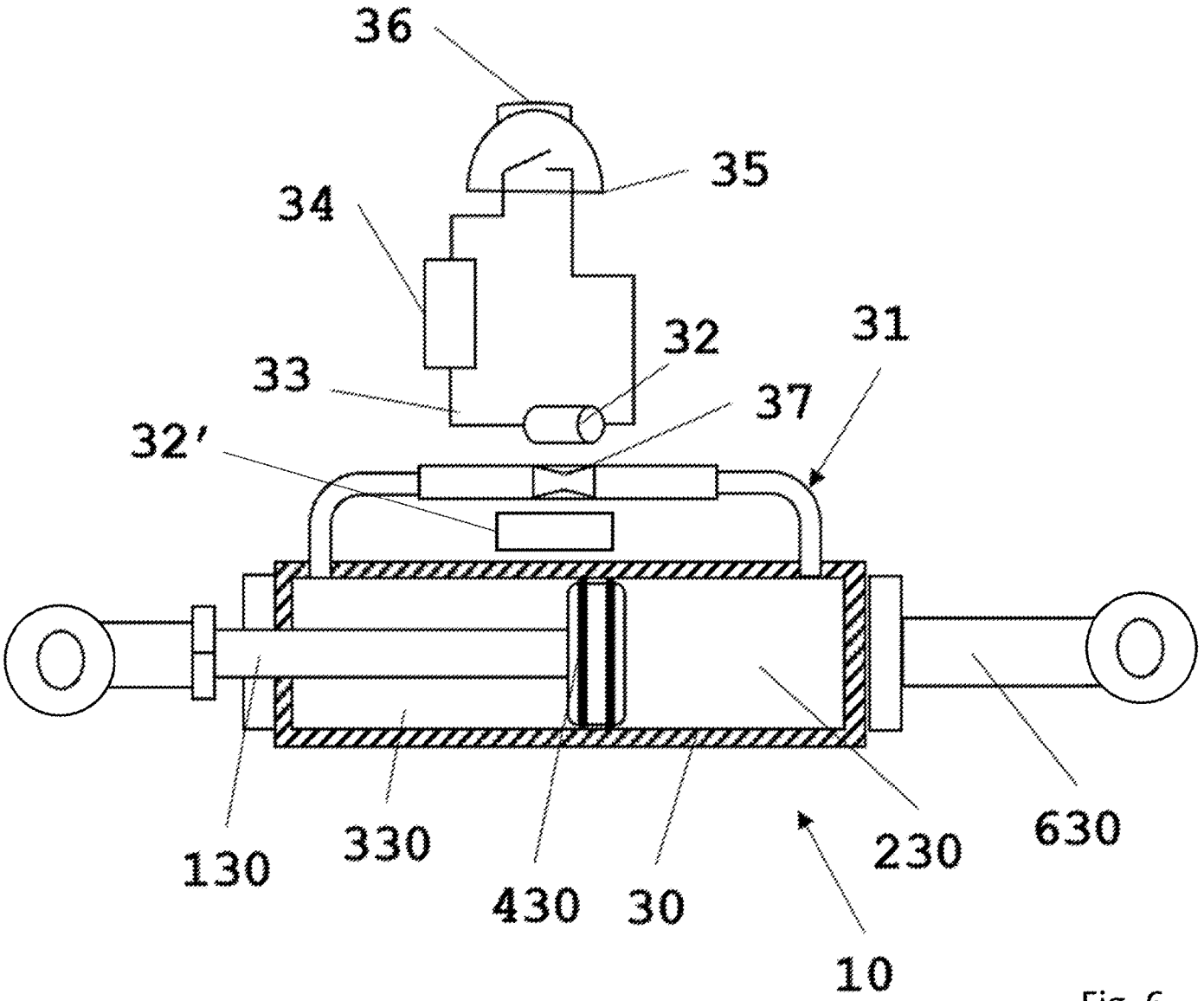
FIG. 6 shows a first embodiment variant of the locking device according to the present invention in combination with the system according to FIG. 3.

In the variant of FIG. 6, as compensating means of the magnetic field of the permanent magnet 32', the magnetic field generator 32 according to the example of FIG. 3 is used. In this case, only the permanent magnet 32' must be added to the system of FIG. 3 and the magnetic field generator must be supplied so that to generate a magnetic field overlapping that of the permanent magnet, whose polarity is inverted with respect to the latter.

It is clear how this solution can easily be implemented alternatively to the one in FIG. 3, thanks to a reprogramming of the control unit of the power source 34 of the magnetic field generator 32, so that to generate a magnetic field of intensity and polarity so that to compensate the field of the permanent magnet.

It is also clear how, in the absence of electric power as a result of an on-board failure, the power supply of the magnetic field generator 32 is lost and therefore the compensation field is null, therefore the fluid is permeated only by the field of the permanent magnet 32' and assumes the condition of maximum viscosity and therefore locks the tie bar. This condition occurs automatically in the absence of electric power and remains stable as long as the electric power source is not recovered.

Based on the above, it is also clear that in addition to the setting of the condition of maximum viscosity and minimum viscosity, i.e. maximum fluidity of the magnetorheological fluid, also this variant allows to set intermediate viscosity values of said fluid and therefore allows to operate the locking device as a brake which opposes at a predetermined extent selected by the user to the length variation of the coupling shaft, i.e. to the displacement of the piston 430 in the cylinder 30.

Figure 7:
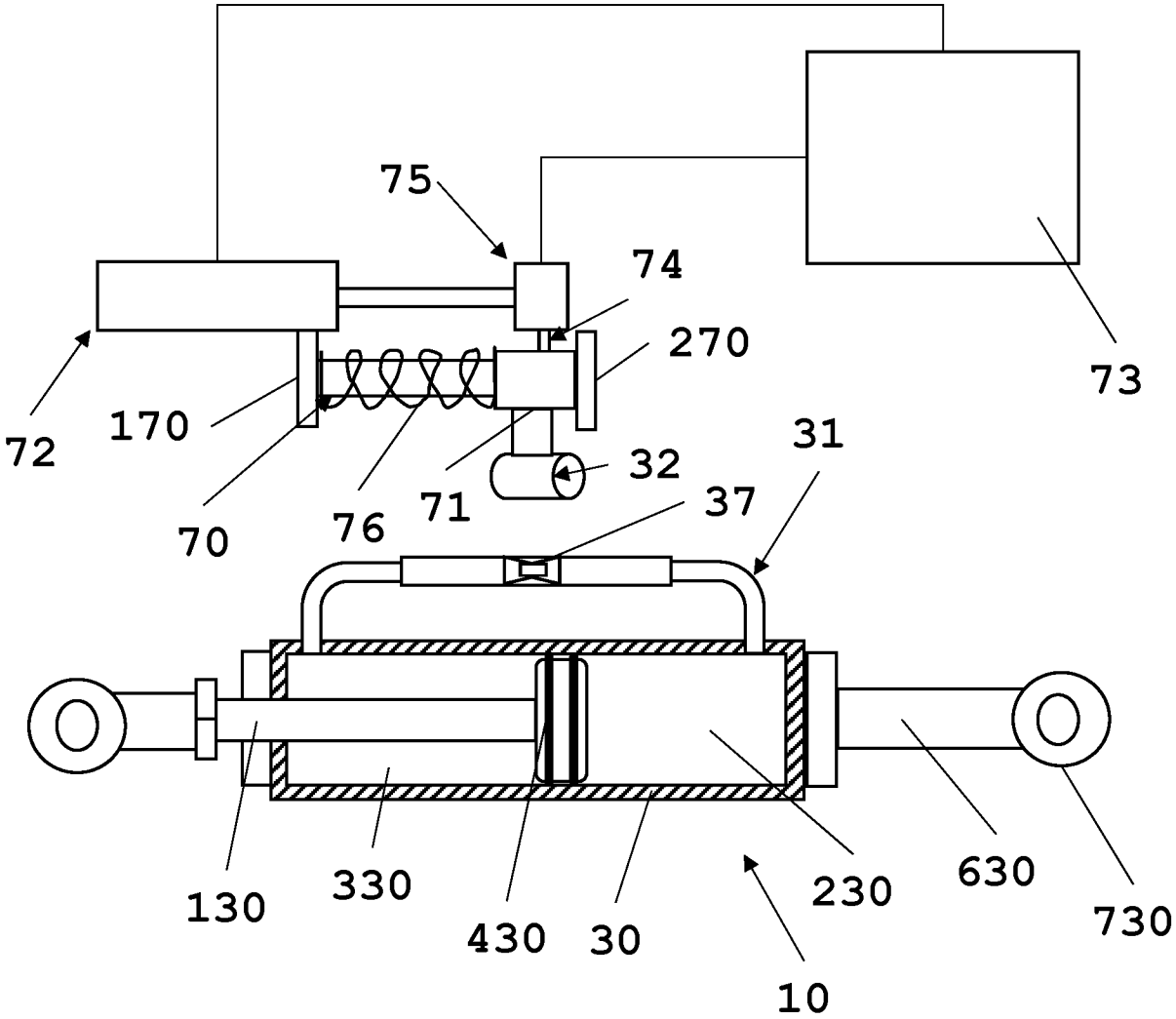
FIGS. 7 to 9 schematically show a further embodiment variant of the locking device applied to an engine tie bar and which comprises varying means to vary the magnetic flux through the magnetorheological fluid or ferrofluid thanks to a displacement of a permanent magnet with respect to said fluid, respectively in the two positions of the magnet corresponding to the position of maximum viscosity and minimum viscosity of the fluid and in the safety position of maximum viscosity in the absence of power supply of the displacement actuating means of the magnet.
Figure 9:
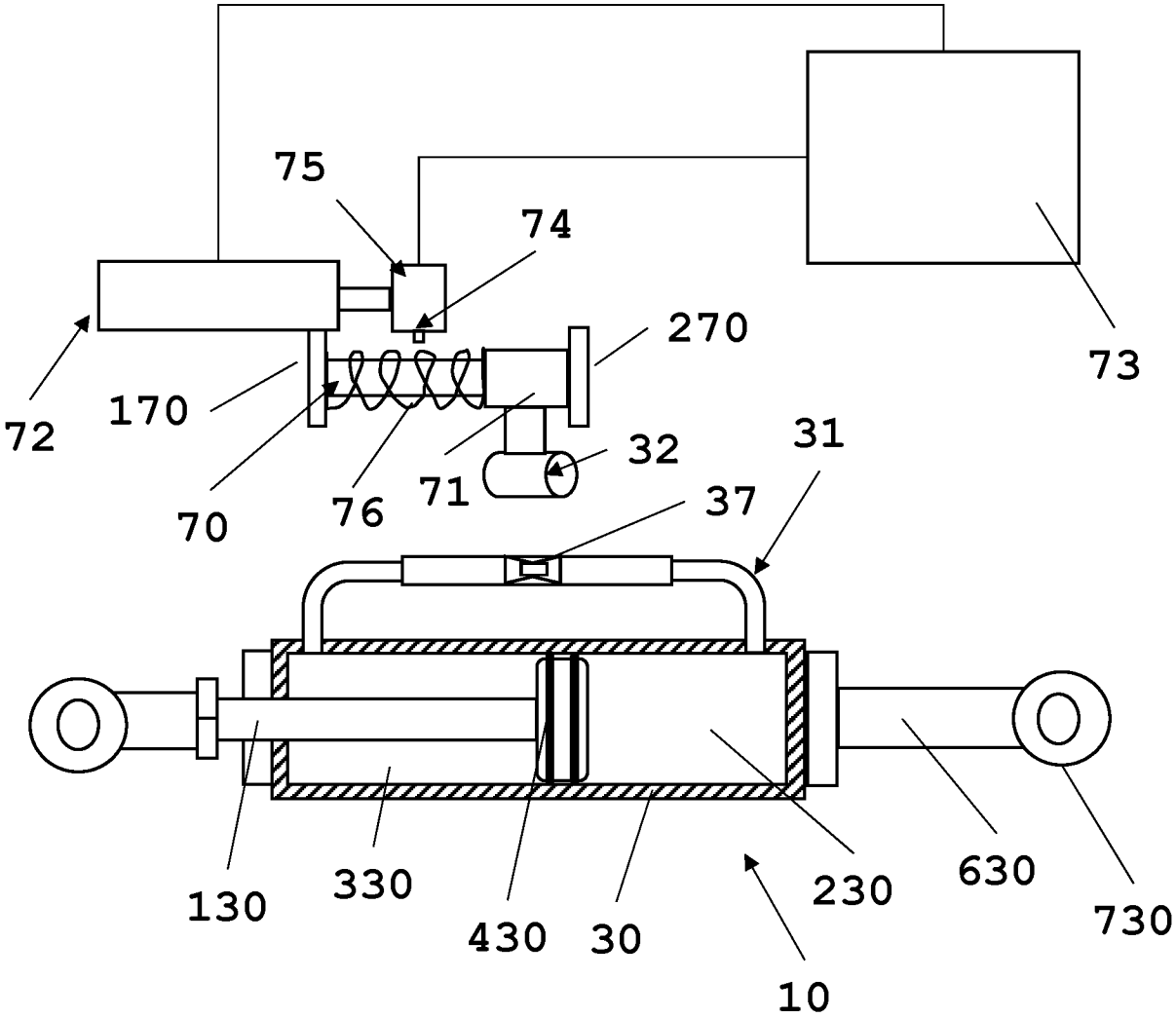

The variant according to FIGS. 7 and 9 instead provides to vary the magnetic flow through the magnetorheological fluid or ferrofluid by displacing the permanent magnet with respect to said fluid. In this case, the fluid interferes with the weakest or more intense field lines and therefore correspondingly modifies its viscosity between the two values of maximum viscosity corresponding to the locking condition and to the condition of minimum viscosity corresponding to the unlocked condition.

Even in this case, it is possible to set intermediate viscosity values between the maximum one and the minimum one, correspondingly regulating the distance of the permanent magnet from the magnetorheological or ferrofluid and therefore ensuring that the progressively more intense or weaker field lines permeate the fluid.

The safety aspect is achieved by subjecting the permanent magnet to elastic means which, in the absence of power condition, firmly and automatically push the permanent magnet in the position, with respect to the fluid, corresponding to that of the maximum viscosity of the fluid.

Therefore, an embodiment provides a displacement guide of the permanent magnet along a predetermined path between an end position of maximum moving away from and maximum moving closer of the permanent magnet with respect to said fluid, i.e. between a position of the permanent magnet in which the magnetic field permeating the fluid is absent or has a minimum intensity and a position of the magnet in which the magnetic field permeating said fluid has maximum intensity;

a displacement actuator of said magnet along the guide between the position of maximum moving away from and minimum moving away from said fluid and which is controlled by the user, directly or indirectly;

a mechanical coupling unit of the displacement actuator to the permanent magnet and which is maintained in an active coupling condition when supplied by an electric power signal, whereas it automatically switches to a decoupling condition when the electric power signal is absent;

a spring which firmly pushes the permanent magnet along the guide towards the position of maximum moving closer to said fluid, i.e. towards the position in which the fluid is permeated by the magnetic field with the maximum intensity.

Figure 8:
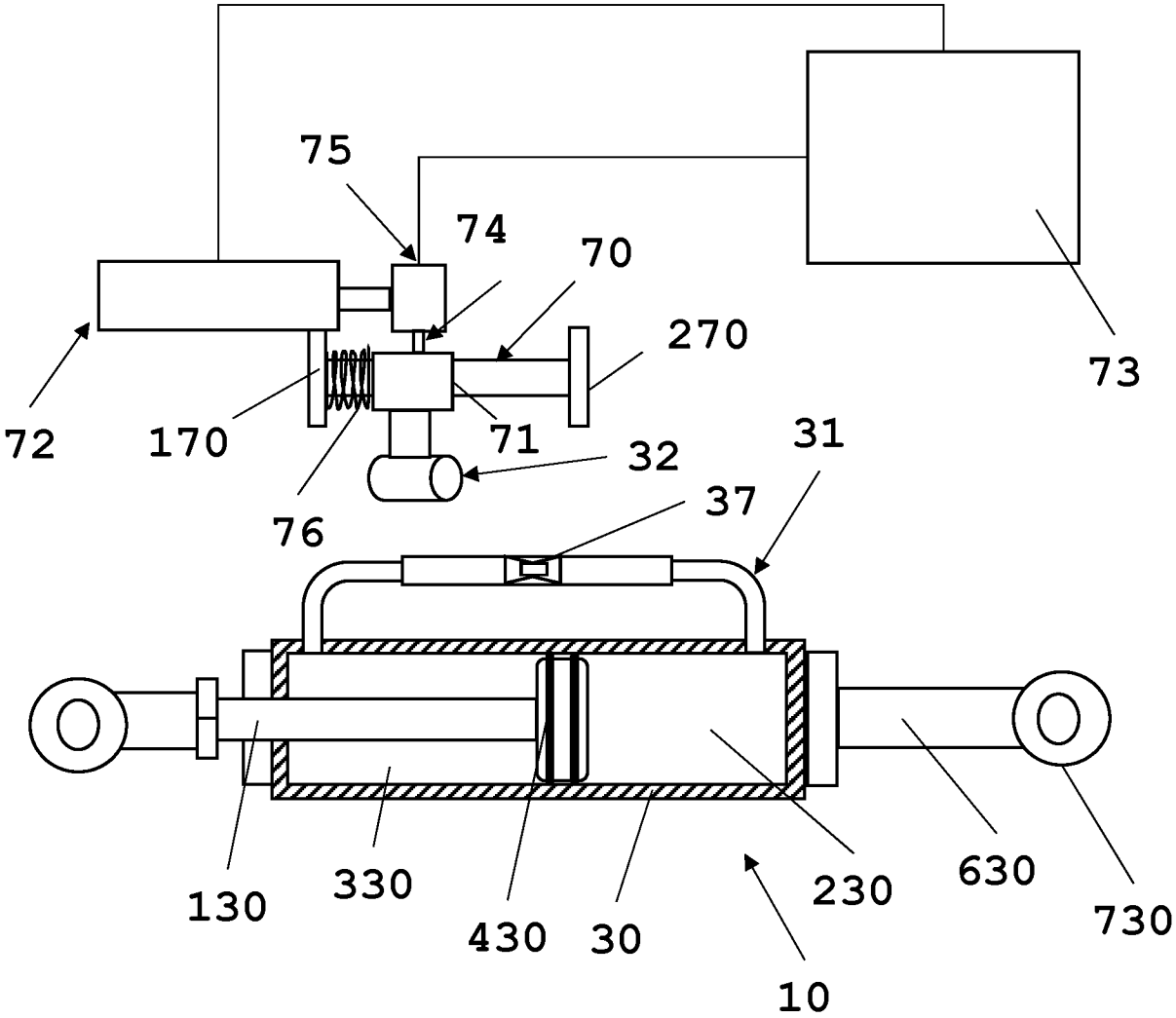

This embodiment is schematized in FIGS. 7 to 9, denoting by 70 a sliding guide for a slide 71 to which the permanent magnet 32 is fixed.

The guide 70 has two stroke limits 170 and 270 at which the permanent magnet assumes the position in which the intensity of the magnetic field permeating the fluid, in particular in the narrowing 37, is maximum as shown in FIG. 7 and in FIG. 9 and the position of the permanent magnet in which the intensity of the magnetic field permeating the fluid, in particular the narrowing 37, is minimum as shown in FIG. 8.

A linear actuator of any type, denoted by 72, is controlled by a control unit 73. The piston rod of the linear actuator 72 is removably coupled to the slider 71 by means of a tooth 74 whose position of engagement and disengagement with the slider 71, for example with a recess or an engaging notch provided on the slider 71, is controlled by an actuator, for example an electromagnetic actuator 75. This electromagnetic actuator 75 comprises a spring which firmly pushes the tooth 74 in the position of disengagement with the slider 71 in the absence of power to an electromagnet which generates a mechanical thrusting or attracting force of the tooth 74 in the condition of engagement with the slider 71. The electromagnetic actuator 75 is also controlled by the control unit 73 which firmly provides the power supply signal of the electromagnet, whereby in the presence of electric power, the slider 71 is coupled with the linear actuator 72 and is displaced forward and backwards between the two end positions 170, 270 thereof on command of the user.

An elastic spring 76 interposed between the slider 71 and the stroke limit 270 is preloaded so that to firmly push the slider 71 to the stroke limit position corresponding to the condition in which the magnetic field permeating the fluid is maximum, i.e. the fluid assumes the maximum viscosity provided.

In the absence of power, the power supply signal of the electromagnet is lost and the spring acts on the tooth 74, bringing it in a position of disengagement of the slider 71, which is free to slide along the guide 70 and is pushed by the spring 76 towards the stroke limit 170, i.e. in the position in which the magnetic field permeating the fluid is maximum, i.e. the fluid assumes the maximum viscosity provided.

Figure 10:
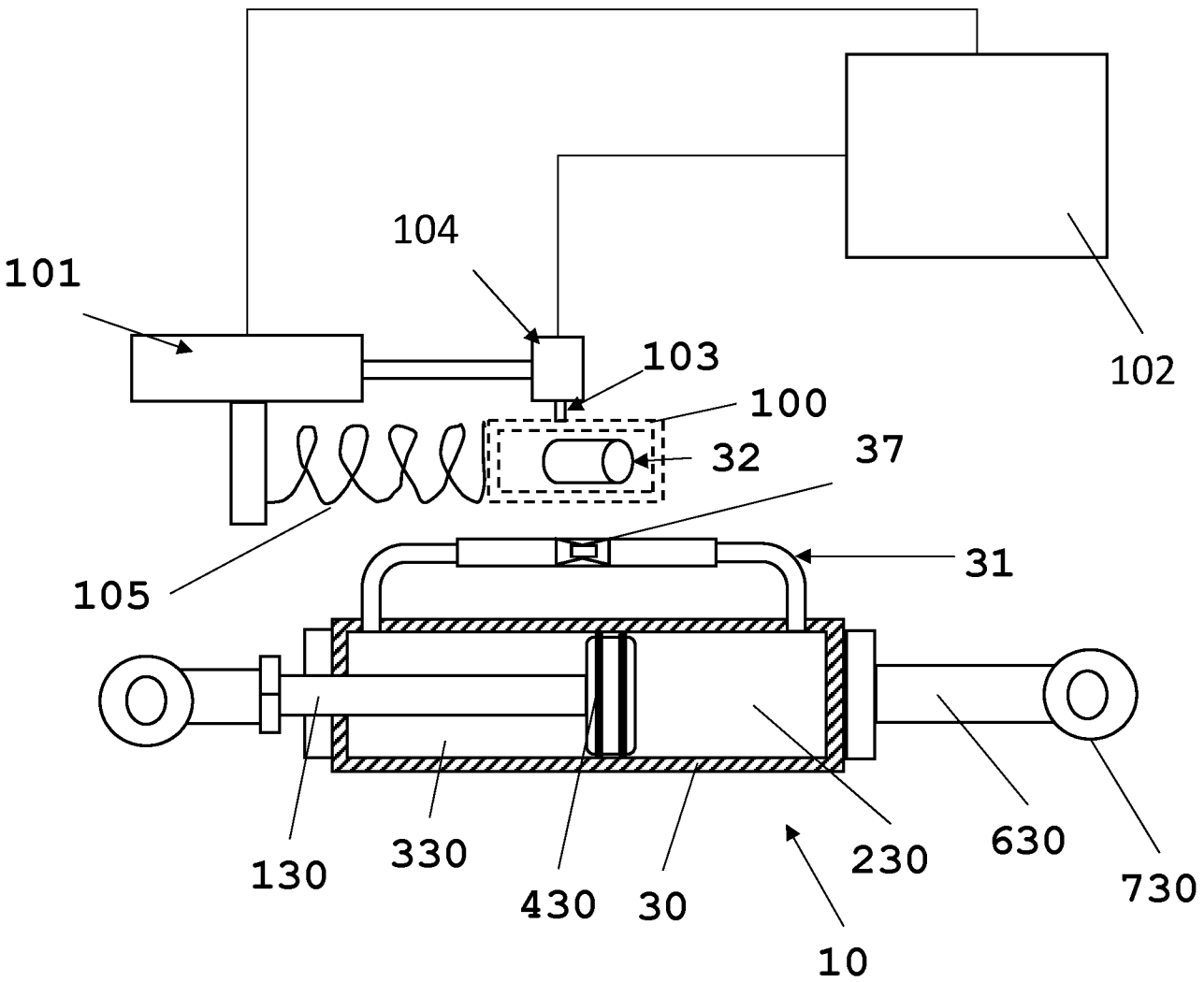
FIGS. 10 to 12 schematically show a third embodiment variant of the locking device applied to an engine tie bar, and which comprises varying means to vary the magnetic flux through the magnetorheological fluid or ferrofluid thanks to a displacement of a shielding element of the magnetic field of a permanent magnet with respect to said fluid, respectively in the two end positions of said shielding means corresponding to the position of maximum viscosity and minimum viscosity of the fluid and in the safety position of maximum viscosity in the absence of power supply of the displacement actuating means of the shielding means of the magnet.
Figure 11:
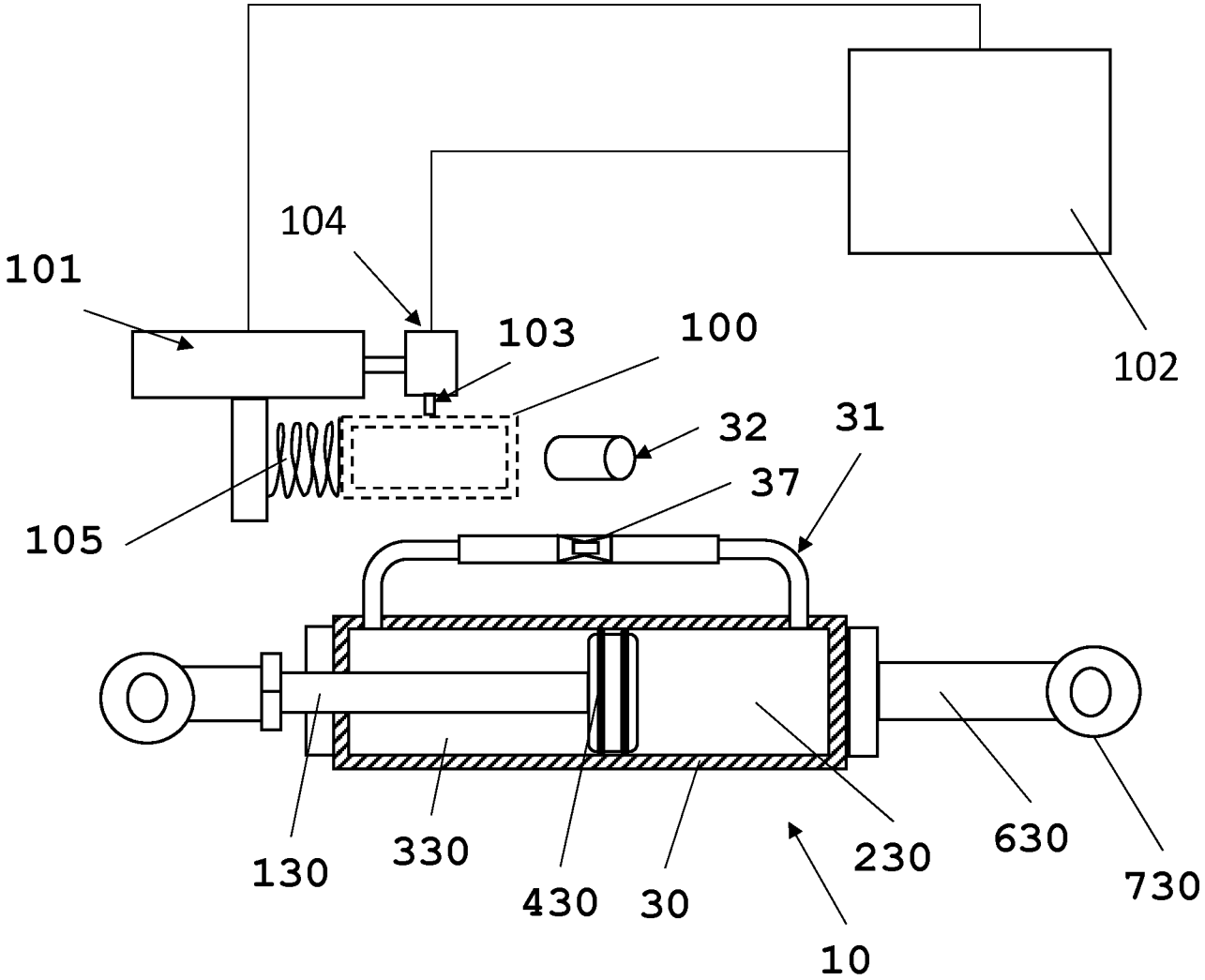
Figure 12:
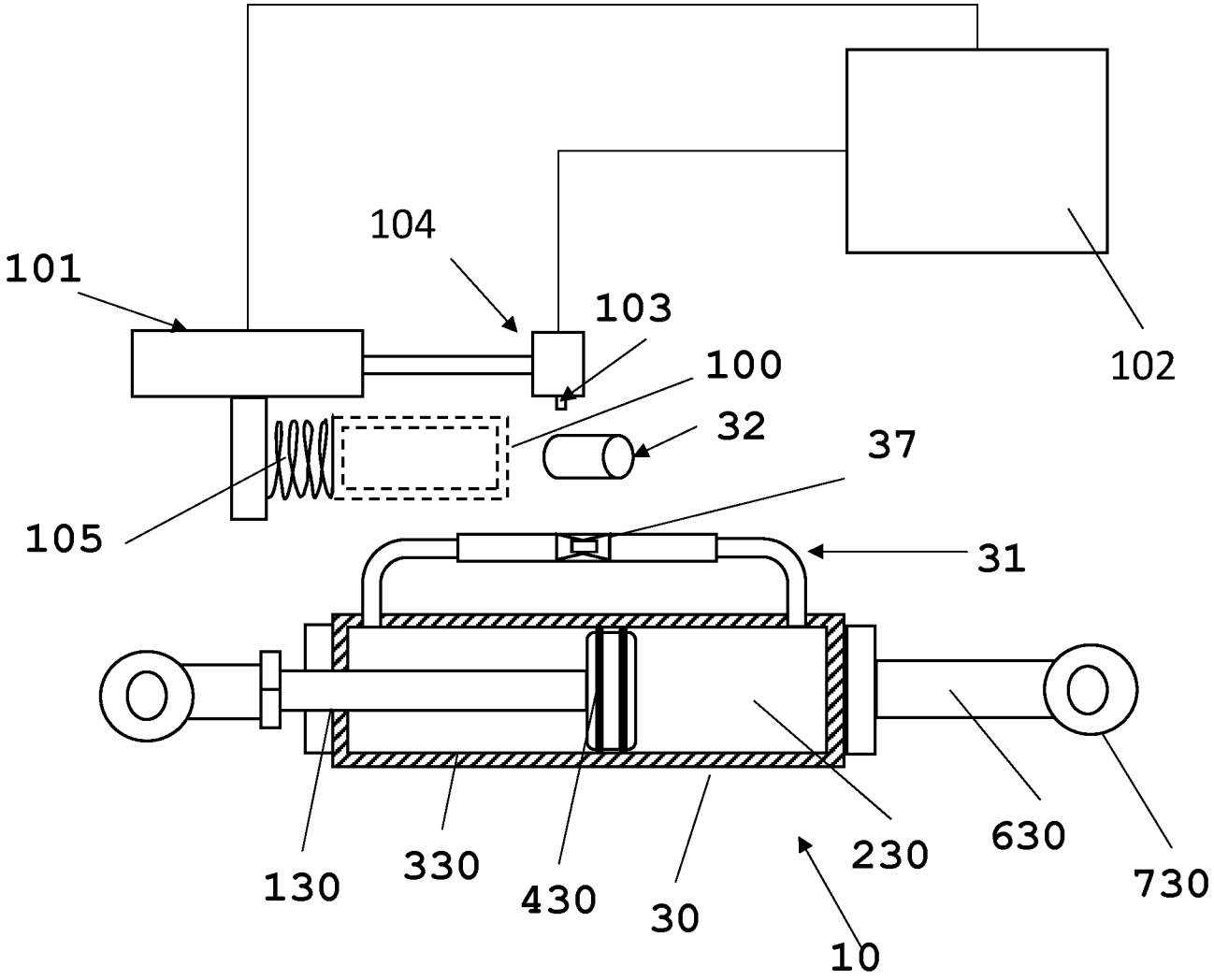

In the embodiment variant of FIGS. 10 to 12, instead of the displacement of the permanent magnet 32, a shielding element 100 of the magnetic field which is movable relatively to the permanent magnet 32 is provided, so that to assume a position of maximum shielding of the magnetic field of the permanent magnet 32 or to not shield said magnetic field with respect to the fluid.

The shielding element can be made so that to be able to be displaced so that to progressively shield the magnetic field, being displaced along a path between a position in which the shielding is absent and a position in which the shielding is complete or anyhow at such a level at which the residual intensity of the magnetic field is insufficient to increase the viscosity of the fluid beyond a certain predetermined minimum value.

There are different possible solutions and, in the exemplary embodiment shown, the shielding element 100 is in the form of a cylinder of ferromagnetic material. By providing a finite length of the cylinder, greater than the extension of the magnet 32, it is possible to shield the field to an extent sufficient to limit the residual intensity thereof due to the fact that the shielding has scattering paths of the magnetic field at the open ends at such a value so that to prevent a significant increase of the viscosity of the fluid.

Similarly to the embodiment of the previous FIGS. 7 to 9, a displacement actuator 101 of the shielding element 100 which is controlled by a control unit 102 and which allows the user to displace the shielding element with respect to the magnet is provided, so that to completely or only partially shield the magnetic field with respect to the fluid.

The displacement actuator 101 connects to the shielding element 100 by means of a removable coupling unit. This is depicted schematically and in a non-limiting way by a tooth 103 which is engaged in a notch (not shown) of the shielding element 100 or a support therefor and which can be displaced between a coupling position to a decoupling position from the shielding element 100, similarly to the tooth 74 of the previous exemplary embodiment.

A possible embodiment provides for example for an electromagnetic actuator 104 which comprises a spring pushing the tooth 103 firmly to the position of disengagement from the shielding element 100 or from a support thereof, in the absence of power supply to an electromagnet. In the presence of the power supply signal of the electromagnet, this generates a mechanical thrusting or attracting force of the tooth 103 in the condition of engagement of the shielding element 100 or of the support thereof. The electromagnetic actuator 104 is also controlled by the control unit 102 which firmly provides the power supply signal of the electromagnet, whereby in the presence of electric power, the shielding element is coupled with the actuator 102 and is displaced forward and backwards between the two end positions, as shown in FIGS. 10 and 11 on command of the user.

An elastic spring 105 interposed between the shielding element 100 and a stationary corresponding part 106 is preloaded so that it firmly displaces the shielding element 100 to the stroke limit position corresponding to the condition in which the magnetic field permeating the fluid is maximum, i.e. the fluid assumes the maximum viscosity provided, as shown in FIG. 12.

In the absence of power, the power supply signal of the electromagnet is lost and the spring acts on the tooth 103 bringing it in a position of disengagement of the shielding element 100. The latter is free to slide and is displaced by the spring 105 to the position in which the magnetic field permeating the fluid is maximum, i.e. the fluid assumes the maximum viscosity provided.

A further not shown embodiment variant can provide that the shielding element of the fluid from the magnetic field is combined with the fluid itself, i.e. in the area of the narrowing 37 and that, in this case, it can be displaced between two end positions, one in which the fluid is completely shielded from the magnetic field and one in which the fluid is exposed to the magnetic field, it being possible to provide, between said two end positions of the shielding element, intermediate positions thereof at which a greater or lesser progressive and partial shielding of the fluid from the magnetic field occurs, which corresponds to conditions of greater or lesser viscosity between the maximum viscosity and the minimum one provided for the functionalities of the system.

In principle, the displacement of the shielding element can be carried out, mutatis, mutandis, by using the same combination of means of the previous example according to FIGS. 10 to 12.

In relation to the embodiments described, they are only schematic, the expert of the field being free to choose among the more adequate known solutions at the state of the art.

Moreover, it is possible that at least two of the described embodiments are used in combination between them, so that to optimize the control of the viscosity in an optimized way in the context of predetermined ranges of viscosity.

Figure 13:
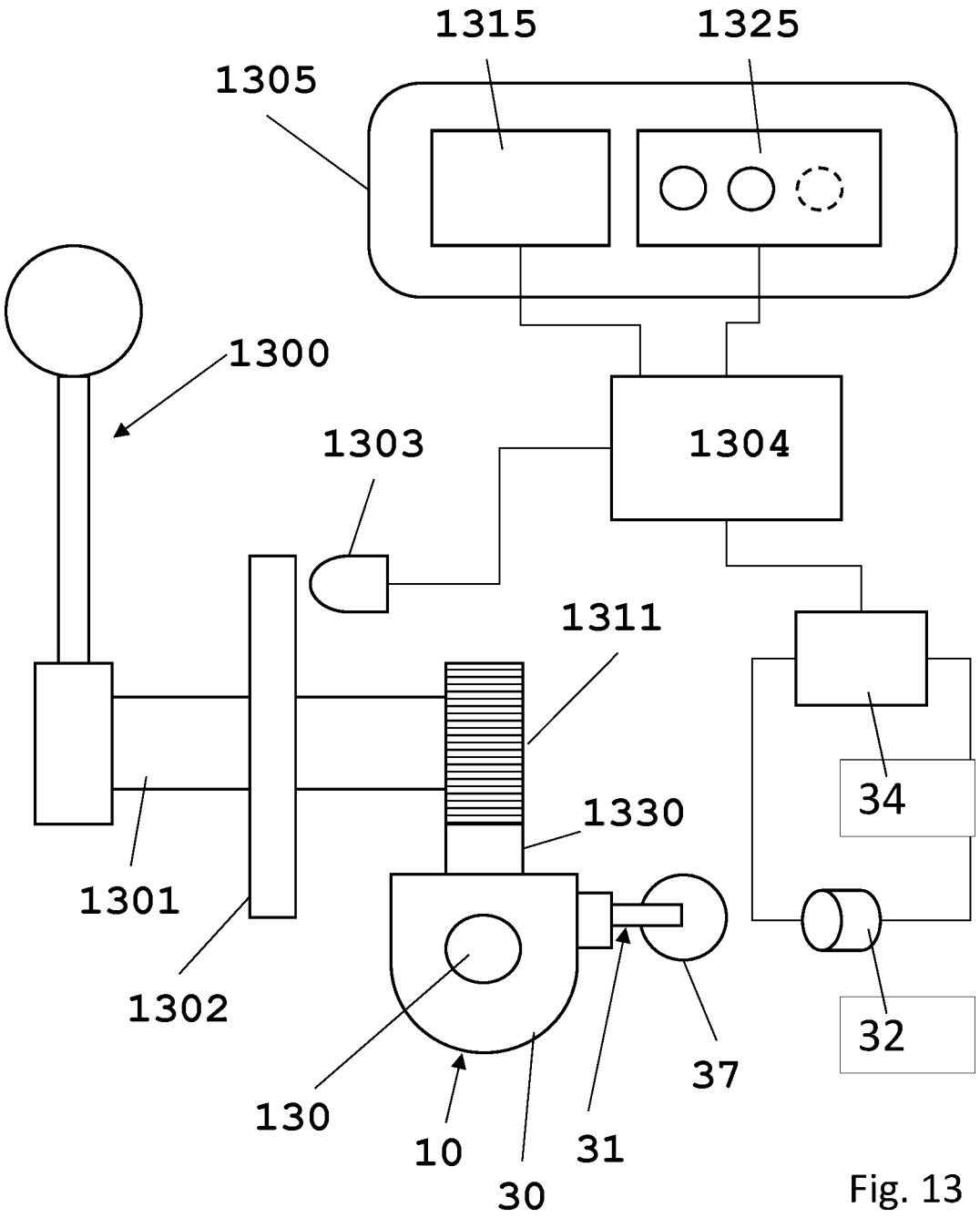
FIGS. 13 and 14 schematically show a further use example of the device according to the present invention, which can operate both as a stroke limit and as a brake or friction which modify the resistance of the control lever relatively to its rotation.
Figure 14:
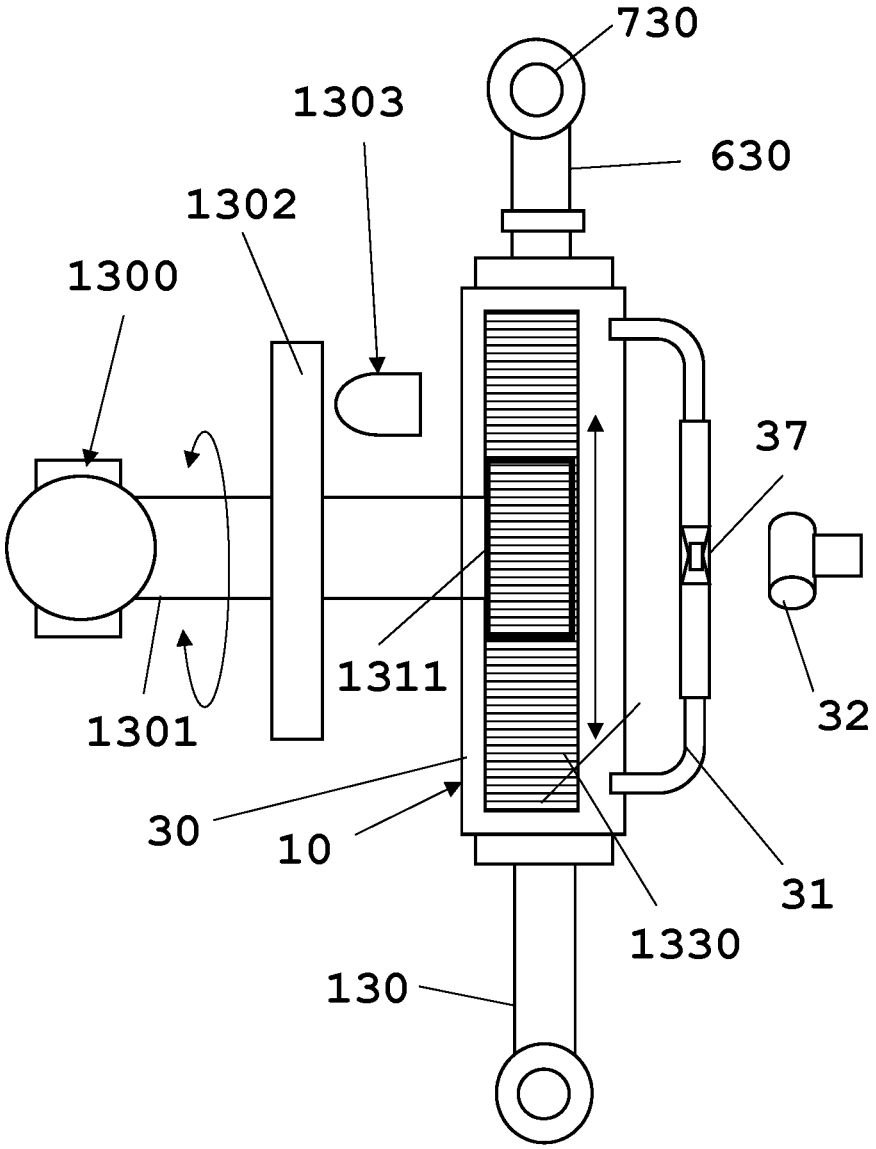

With reference to FIGS. 13 and 14, the application example of the device according to the present invention concerns a control lever of the variation of the number of revolutions of the engine and/or of the variation in the rotation direction.

The example shown concerns, for simplicity, a variant of the lever in which the angular displacement of the lever 1330 is read by a sensor 1303, for example an optic reflection sensor or the like which cooperates with an encoding disk 1302, or with a hall sensor which cooperates with a disk on which magnetized, non-magnetized areas or areas magnetized with reverse polarities are alternatively provided.

The encoding disk 1302 is wedged on a spindle 1301 which is rotated by the swinging of the lever 1300. A toothed wheel 1311 which cooperates with a rack 1330 integral with the cylinder 30 of a linear actuator 10 of the type described with reference to the previous examples, is wedged on the spindle 1301. The rack is oriented parallel to the axis of the cylinder. The cylinder 30 is mounted on a coaxial piston rod 130 which is held in a fixed position by stationary corresponding parts, whereas the cylinder 30 can slide along the piston rod 130.

As in the previous examples, the piston rod brings a piston not shown in FIGS. 13 and 14 in median position and divides the cylinder into two chambers. These are connected to each other by a bypass 31 which, at in an intermediate point thereof, has a narrowing 37. At the narrowing 37, an electromagnet 32 which is connected to a power source 34 is provided. The signals of the sensor 1303 detecting the angular displacement angle of the lever 1300 are transmitted to a control unit which determines the measure of the swinging angle and which, thanks to a user interface 1305, can be programmed, in the sense of setting and storing at least one, two angular positions on two opposite sides of the vertical position of the lever 1300, or more angular positions along the swinging path of the lever, at the reaching of which the lever is either locked, preventing the displacement thereof at least in the same direction or the resistance to the swinging of the lever is changed, by increasing or reducing said resistance at the reaching and/or exceeding of a certain angular position or along travel arcs of the lever between two predetermined angular positions defining the start and end positions of said travel arcs. This way, the swinging of the lever can be adapted to the use conditions desired by the user or recommended by the navigation conditions. When for example the conditions of the sea are bad and the stability of the individual driving is precarious or difficult, the resistance to the angular displacement of the lever can be increased to limit sudden displacements of the lever due to partial losses of balance of the individual in command.

The user interface 1305 can provide for a screen 1315 and/or a keyboard 1325 with control keys and settings of operative conditions that can also be preset and recalled by the user himself, or to modify parameters of said settings to customize them.

The control of the power supply of the electromagnet 34 which generates the magnetic field to vary the viscosity of the magnetorheological fluid is advantageously performed by the central control unit 1304 which, based on the angular displacements of the lever 1300 and the settings of the user, activates or deactivates the power source or modulates the power supply of the electromagnet and therefore the magnetic field and consequently the viscosity variation of the fluid.

In relation to the example shown, it can also be made according to any of the further variants referred to in the examples described with reference to FIGS. 7 to 12, obviously with the modifications of the case to adapt it to the different use conditions.

The invention claimed is:

1. A device for locking an actuation stroke of control kinematic chains in marine vessels, comprising:

a closed hydraulic circuit in which a fluid circulates, said hydraulic circuit comprising, at least one locking actuator with a locking member movable along a predetermined stroke and operationally connected to a control kinematic chain, said locking actuator being adapted to be alternatively switched into a braked or locked condition of said locking member and into a condition of free movement of said locking member in relation to said predetermined stroke thereof, and a switching unit that switches between active and inactive conditions of the locking actuator, the switching unit comprising a preventing member that prevents fluid flow in said hydraulic circuit, the switching unit being adapted to be alternatively controlled between a condition of free flow of fluid corresponding to a condition in which the locking member is free in relation to its stroke, and a condition of at least limited flow rate of the fluid or increased resistance to circulation of the fluid, in which movement of the locking member along the stroke is braked or is in a condition of completely preventing the fluid flow where the locking member cannot move along its predetermined stroke, wherein the fluid comprises of a magnetorheological liquid or a ferrofluid, wherein the switching unit comprises both a magnetic field generator coupled to at least one section of the hydraulic circuit and an element that varies intensity of a magnet or a flux of a magnetic field that permeates said magnetorheological liquid or said ferrofluid, and wherein the magnetic field generator is an electromagnetic field generator and a switch/regulator of a power supply of the magnetic field generator is provided and opens and closes a connection of a power source to said magnetic field generator and/or regulates intensity of a power supply signal to said magnetic field generator.

2. The device according to claim 1, wherein the magnetic field generator comprises one or more permanent magnets, and further comprising, in combination with said one or more permanent magnets, or alternatively thereto, or in combination with each other, a second magnetic field generator to partially and progressively, or completely, compensate, or replace, the magnetic field generated by the one or more permanent magnets, a shielding element to partially and progressively, or completely, shield the magnetic field generated by the one or more permanent magnets, and a varying element to vary either magnetic flux or intensity of the magnetic field generated by the one or more permanent magnets, which permeates said fluid by relatively moving the one or more permanents magnet relative to the fluid.

3. The device according to claim 2, wherein one or more of the shielding element or the permanent magnet are adapted to be moved with one or more motorized actuators along predetermined paths and between two end positions, in which the intensity of the magnetic field permeating said fluid or the magnetic flux through said fluid is such that said fluid assumes a predetermined condition of maximum viscosity and a predetermined condition of minimum viscosity, respectively, further comprising elastic elements in combination with, and permanently biasing, one or both of the permanent magnet or the shielding element in a position in which the fluid assumes the predetermined condition of maximum viscosity, and an automatic unit for decoupling one or both of the permanent magnet or the shielding element from the motorized actuator in case of absence of an electric power supply to said one or more motorized actuators.

4. The device according to claim 1, wherein the hydraulic circuit provides for a partial narrowing or reduced-diameter section in a by-pass duct, said magnetic field generator being provided at said narrowing or said reduced-diameter section whose diameter is reduced with respect to a diameter of the by-pass duct.

5. The device according to claim 1, wherein said locking member of the switching unit comprises a manual switch having at least two stable positions, a first stable position corresponding to a condition of generating a magnetic field and a second stable position corresponding to a condition of absence of the magnetic field.

6. A device for locking an actuation stroke of control kinematic chains in marine vessels, comprising:

a closed hydraulic circuit in which a fluid circulates, said hydraulic circuit comprising, at least one locking actuator with a locking member movable along a predetermined stroke and operationally connected to a control kinematic chain, said locking actuator being adapted to be alternatively switched into a braked or locked condition of said locking member and into a condition of free movement of said locking member in relation to said predetermined stroke thereof, and a switching unit that switches between active and inactive conditions of the locking actuator, the switching unit comprising a preventing member that prevents fluid flow in said hydraulic circuit, the switching unit being adapted to be alternatively controlled between a condition of free flow of fluid corresponding to a condition in which the locking member is free in relation to its stroke, and a condition of at least limited flow rate of the fluid or increased resistance to circulation of the fluid, in which movement of the locking member along the stroke is braked or is in a condition of completely preventing the fluid flow where the locking member cannot move along its predetermined stroke, wherein the fluid comprises of a magnetorheological liquid or a ferrofluid, and wherein the switching unit comprises both a magnetic field generator coupled to at least one section of the hydraulic circuit and an element that varies intensity of a magnet or a flux of a magnetic field that permeates said magnetorheological liquid or said ferrofluid, further comprising, for the magnetic field generator, a power source that provides a power supply signal of variable intensity to the magnetic field generator, whereby the magnetic field intensity can be regulated to different values, thus generating not only conditions of free movement or complete locking, but also conditions of greater or lesser braking of the movement.

7. The device according to claim 6, wherein regulators of the intensity of the power supply signal are provided so as to supply the magnetic field generator with a signal power corresponding to a predetermined magnetic field intensity and, therefore, to a preset fluid viscosity condition between two extreme conditions of maximum and minimum possible viscosities.

8. The device according to claim 6, wherein the magnetic field generator is an electromagnet adapted to generate a magnetic field having variable intensity or magnetic flux depending on power of the power supply signal.

9. A device for locking an actuation stroke of control kinematic chains in marine vessels, comprising:

a closed hydraulic circuit in which a fluid circulates, said hydraulic circuit comprising, at least one locking actuator with a locking member movable along a predetermined stroke and operationally connected to a control kinematic chain, said locking actuator being adapted to be alternatively switched into a braked or locked condition of said locking member and into a condition of free movement of said locking member in relation to said predetermined stroke thereof, and a switching unit that switches between active and inactive conditions of the locking actuator, the switching unit comprising a preventing member that prevents fluid flow in said hydraulic circuit, the switching unit being adapted to be alternatively controlled between a condition of free flow of fluid corresponding to a condition in which the locking member is free in relation to its stroke, and a condition of at least limited flow rate of the fluid or increased resistance to circulation of the fluid, in which movement of the locking member along the stroke is braked or is in a condition of completely preventing the fluid flow where the locking member cannot move along its predetermined stroke, wherein the fluid comprises of a magnetorheological liquid or a ferrofluid, wherein the switching unit comprises both a magnetic field generator coupled to at least one section of the hydraulic circuit and an element that varies intensity of a magnet or a flux of a magnetic field that permeates said magnetorheological liquid or said ferrofluid, wherein the device is provided in combination with a directional control system of a marine vessel comprising two or more outboard marine engines connected together by tie bars to control steering in a synchronized manner, wherein, both during set-up and in use, relative steering angles or rudder angles between the two or more outboard engines engines with respect to each other have to be changed, wherein each tie bar has variable length and consists of a hydraulic cylinder comprising two chambers separated by a piston carrying a piston rod, the two chambers being connected by a by-pass circuit, whereas the fluid filling the by-pass circuit is the magnetorheological liquid or the ferrofluid, and wherein the magnetic field generator combined with at least one segment of said by-pass circuit is provided in such a position that the generated field permeates said at least one segment of the by-pass circuit and said magnetic field generator is able to be activated and deactivated either by user's control or automatically by control of a control unit.

10. The device according to claim 9, wherein not only conditions of free movement and locking are provided but also a regulating member that regulates either the intensity of the magnetic field or the magnetic flux permeating said magnetorhelogical liquid, said regulating member being adapted to regulate power of a power supply signal of the magnetic field generator and, therefore, a condition of fluid viscosity so as to set a resistance to free movement and thus a braking condition.

11. The device according to claim 10, wherein the device is comprised in a device auxiliary to a manual steering control device of high power marine engines, wherein a directional control system of a boat comprises, a steering control member manually operated by a user and operationally connected to a direction-variation member acting on or in water, said direction-variation member being at least one rudder blade or at least one outboard engine and having an angular position with respect to a longitudinal axis of the marine vessel that is controlled by said control member, and a locking system that locks a free variation of an angular position of said direction-variation member, said locking system being adapted to be activated and deactivated in order to allow said variation of the angular position, so as to carry out a directional change, wherein said locking system comprises a hydraulic actuator comprising a sealed cylinder and a piston dividing the sealed cylinder into two chambers, said two chambers being connected by a by-pass circuit which is configured to be opened and closed with a switching member, a piston rod or the sealed cylinder being articulated to the kinematic chain for an angular movement of the direction-variation member and/or to the steering control member, wherein the fluid circulating between one chamber and the other chamber of the sealed cylinder comprises the magnetorheological liquid or the ferrofluid, and wherein the switching member that switches the locking actuator between the active and inactive conditions comprises both the magnetic field generator coupled to at least one section of the by-pass circuit, so that the magnetic field permeates at least said at least one section of the by-pass circuit, and a varying element that varies magnetic intensity or a flux of the magnetic field permeating said magnetorheological liquid or said ferrofluid.

12. The device according to claim 11, wherein the magnetic field generator is electromagnetic, further comprising a switch/regulator of the power supply of the magnetic field generator which opens and closes a connection of a power source to said magnetic field generator and/or regulates intensity of the power supply signal to said generator, wherein switch regulator comprises an electric switch that opens and closes a power/regulating circuit of the power supply signal to said magnetic field generator.

13. The device according to claim 12, wherein the electric switch is controlled by a button having two stable positions corresponding to an open position of the hydraulic circuit and a closed position of the hydraulic circuit.

14. The device according to claim 12, wherein the electric switch is controlled by the outboard engine's steering control member, the steering control member being articulated to the outboard engine to swing along a given switching-control stroke limited with respect to a steering stroke around an axis parallel to a steering axis, wherein the steering stroke in both directions with respect to a central position controls the electric switch in a direction of closing a power circuit of the magnetic field generator, and wherein in an intermediate position of the stroke of the steering arm, between two swing positions with respect to the outboard engine, the electric switch is controlled in a direction of opening a power circuit of the magnetic field generator.

15. The device according to claim 14, wherein the steering arm is swingingly articulated to the outboard engine in an area of a fastening base of the steering arm, where the steering arm is fastened to the outboard engine.

16. The device according to claim 14 wherein the steering arm consists of two parts articulated to each other so as to swing in two steering directions with respect to an intermediate position of substantial alignment of the two parts of the steering arm, one of the two parts being stationarily fastened to the outboard engine and the other one of the two parts forming a steering arm end opposite to the outboard engine and swinging around an axis parallel to a steering axis, in the two steering directions with respect to the intermediate position of alignment with the part fastened to the outboard engine and along a limited switching stroke to switch the power circuit of the magnetic field generator into the closed condition, and wherein in the intermediate position of alignment of the two parts of the steering arm, the electric switch is controlled in the open condition of the power circuit of the magnetic field generator.

17. The device according to claim 1, further comprising a control for regulating magnetic field intensity, the control allowing a viscosity of the magnetorheological liquid or the ferrofluid to be varied between a minimum value and a maximum value which cause a steering movement to be either completely free or locked respectively in an absence of the magnetic field or in a condition of maximum intensity of the magnetic field, wherein, for values of the magnetic field intensity intermediate between the minimum value and the maximum value, a corresponding viscosity intermediate between the maximum value and the minimum value is set, causing the steering movement to be correspondingly braked.

18. The device according to claim 9, wherein the by-pass circuit has a narrowing or diameter reduction in an intermediate section between two inlets to the cylinder chambers, the narrowing or narrowed section being combined with the magnetic field generator a space volume permeated by the field of said magnetic field generator.

19. The device according to claim 11, wherein the control member consists of a control lever that controls a number of revolutions and/or a direction of rotation and a number of revolutions of an outboard engine, said control lever being provided in combination with detecting sensors to detect a position angle of the control lever and communicating with a central control unit which controls generation of the magnetic field and/or a modulation of the intensity thereof based on predetermined presettable parameters related to one or more position angles of the control lever, said control lever being mechanically connected to a locking or braking member by a variation of a resistance to angular movement, the control member being controlled by the locking actuator.

* * * * *